US005334807A

United States Patent [19]

Kubo et al.

[11] Patent Number: 5,334,807

[45] Date of Patent: * Aug. 2, 1994

[54] APPARATUS FOR ELEVATOR GROUP CONTROL HAVING LOW SERVICE FLOOR DETECTION FOR IMPROVED PASSENGER PICKUP EFFICIENCY

[75] Inventors: Susumu Kubo; Shoji Nakai; Masumi Tsunoda, all of Tokyo, Japan

[73] Assignee: Kabushiki Kaisha Toshiba, Kawasaki, Japan

[ * ] Notice: The portion of the term of this patent subsequent to Dec. 1, 2009 has been disclaimed.

[21] Appl. No.: 767,465

[22] Filed: Sep. 30, 1991

[30] Foreign Application Priority Data

Oct. 1, 1990 [JP] Japan ..... 2-260482
Jan. 22, 1991 [JP] Japan ..... 3-20347

[51] Int. Cl.[5] ..... B66B 1/20
[52] U.S. Cl. ..... 187/126; 187/135; 187/129
[58] Field of Search ..... 187/121, 124, 127, 129, 187/135

[56] References Cited

U.S. PATENT DOCUMENTS 4,492,288 1/1985 Schröder ..... 187/127
4,838,384 6/1989 Thangavelu ..... 187/125
5,168,135 12/1992 Kubo et al. ..... 187/127

FOREIGN PATENT DOCUMENTS 0200677 10/1991 Japan ..... 187/124
0211175 10/1991 Japan ..... 187/124
1042658 9/1966 United Kingdom .
2238632 6/1991 United Kingdom .

*Primary Examiner*—Emanuel T. Voeltz
*Assistant Examiner*—Robert Nappi
*Attorney, Agent, or Firm*—Oblon, Spivak, McClelland, Maier & Neustadt

[57] ABSTRACT

An elevator control system which provide a high transportation efficiency and also provides for equalization of service quality between floors when a large number of passengers located at different floors desire transportation to a common particular floor. Passengers waiting at a lower level floor will first be picked up prior to the elevator moving to the upper level floors so that the passengers at the lower levels will also be able to get on the elevator when there is a large number of passengers who wish to go to a particular floor during a particular time of the day.

5 Claims, 28 Drawing Sheets

APPARATUS FOR ELEVATOR GROUP CONTROL HAVING LOW SERVICE FLOOR DETECTION FOR IMPROVED PASSENGER PICKUP EFFICIENCY

BACKGROUND OF THE INVENTION

1. Field of the Invention

The present invention relates to an apparatus for elevator group control used to operate a plurality of elevator cars between a plurality of floors.

2. Description of the Related Art

Recently, in order to improve an operation efficiency of a plurality of parallel elevator cars and to improve service quality for elevator passengers, a microcomputer has been used to systematically and rapidly allocate elevator cars for responding to hall calls on each floor.

When a hall call is generated, an apparatus for group control performs the following control.

1) Control for selecting and allocating, from a plurality of elevator cars, an optimal elevator car for performing service for the hall call.

2) Control for inhibiting other elevator cars except for the allocated elevator car to respond to the hall call.

In the above case, at an elevator hall, an allocation indication lamp arranged near an entrance of the allocated elevator car is turned on, and a chime rings and the indication lamp is flickered immediately before arrival of the elevator car.

In the elevator system as described above, along with recent development of microcomputers, measurement of, such as elevator car call registration data and getting on/off load data is performed in a real-time manner in response to each elevator hall to monitor a traffic flow between the floors.

In addition, the above apparatus for group control predicts a traffic demand from generation of a hall call in accordance with the traffic flow and allocates an optimal elevator car on the basis of the prediction.

In a building where a restaurant is located on a particular floor, a traffic demand for the particular floor is significantly increased during a particular time period such as the first half of a lunch break. Therefore, the particular time period in which the traffic demand is increased requires a transportation efficiency higher than that in an ordinary time period.

The high transportation efficiency is defined by the following conditions:

(1) Service quality is equalized between floors, (2) An elevator car is full or almost full upon arrival at a particular floor, (3) An elevator car heading for a particular floor does not pass floors, allocated to the elevator car and generating hall calls, because the elevator car is full before it arrives at the particular floor.

A conventional apparatus for elevator group control employs the following means in order to ensure a high transportation efficiency. When elevator cars to hall calls on respective floors are allocated, a load on each floor at which an elevator car is to be stopped is predicted along with the predicted nonresponse time. Control is performed in accordance with the prediction such that an allocated elevator car does not pass a floor, at which the elevator car is to be stopped, because it is full. That is, the control is basically performed to allocate elevator cars such that passengers get on operating elevator cars as equally as possible.

As described above, when hall calls are generated from individual floors, elevator cars are allocated by predicting passengers who are to get on from the corresponding halls. However, for peak hours when a traffic demand to a particular floor is significantly increased, the following problems arise because the number of waiting passengers per call is large.

For example, assume that, as shown in FIG. 1, calls are generated on two floors $f_1$ and $f_2$, a predicted load on each floor is 16 passengers, and an elevator car loading capacity is 24 passengers. If an elevator car No. 3 is allocated to the floor $f_1$ and an elevator car No. 1 or 2 is allocated to the floor $f_2$ a predicted response time for the floor $f_2$ is long. Therefore, the elevator car No. 3 arrives at a restaurant floor with 16 passengers, resulting in low transportation efficiency. For this reason, the floor $f_2$ may be allocated to the elevator car No. 3 by relative evaluation. Assume that the number of waiting passengers on each of the floors $f_1$ and $f_2$ coincides with the prediction, i.e., 16, when the elevator car No. 3 is allocated to the floors $f_1$ and $f_2$. In this case, although 16 passengers can get on the elevator car on the floor $f_1$, only eight passengers can get on the elevator car on the floor $f_2$. This is not preferred in terms of equalization in service quality between floors.

As described above, even when allocation is performed in consideration of prediction of loads, if the number of waiting passengers is large on each floor, a floor farther from a particular floor is advantageous while that closer to the particular floor is disadvantageous unless the number of passengers in each elevator car is limited. However, although equalization is realized by limiting the number of passengers as described above, it is actually difficult to limit the number of passengers when use convenience of passengers is taken into consideration.

As a patent application related to this application, there is U.S. Pat. No. 5,168,135 to Kubo et al.

SUMMARY OF THE INVENTION

It is an object of the present invention to provide an apparatus for elevator group control, which can maintain a transportation efficiency and equalize service quality between floors and does not reduce use convenience of waiting passengers, even when destination floors of passengers are concentrated on a particular floor.

An apparatus for elevator group control according to the first aspect of the present invention is characterized in that;

an apparatus for elevator group control, in which a plurality of elevator cars are operated between a plurality of floors, and one of said plurality of elevator cars is allocated to respond to a hall call generated by passengers on each floor, comprises:

operational state detecting means for detecting operational states of said elevator cars;

traffic demand concentration determining means for determining, on the basis of the detection result of said operational state detecting means, whether destination floors of passengers are concentrated on a particular floor;

low service quality floor detecting means for detecting, when said traffic demand concentration determining means determines that a traffic demand is concentrated, a floor at which service quality for passengers is lowered; and elevator responding means for causing an elevator car, which is allocated to said low service quality floor extracted by said low service quality floor detecting means, to respond to said low service quality floor when said elevator car operates in a direction opposite to said particular floor, wherein said low service quality floor detecting means determines, as a floor to which said elevator car responds while operating in the opposite direction, at least one of (1) a floor from which an elevator car starts full of passengers in a direction toward a particular floor immediately preceding stopping of the car, (2) a hall call allocated floor passed by an elevator car full of passengers, (3) a floor at which a hall call elapsed time is a predetermined time or more, (4) a floor at which a predicted nonresponse time is a predetermined time or more, (5) a floor having a maximum nonresponse time of hall call allocated floors of an elevator car operating in a direction toward a particular floor, (6) a floor at which the number of passengers capable of getting on is a predetermined value or less immediately preceding stopping of the car, and (7) a floor at which a boarding accumulated value ratio of the floor in a predetermined time period is lower than a boarding queue based on past statistical data.

In the arrangement corresponding to the first aspect of the present invention, the operational state detection unit performs operational state detection for each elevator car. If it is determined on the basis of the detection that the operational state exceeds a predetermined level, the traffic demand concentration determination unit determines whether destination floors of passengers are concentrated on a particular floor.

If the traffic demand concentration determination unit determines that the destination floors of the passengers are concentrated, 1) the low service quality floor determination unit extracts and determines, from allocated calls, a floor at which service quality for passengers is reduced, and 2) the elevator response unit causes an elevator car allocated to the low service quality floor to respond to the floor when the elevator car operates in a direction opposite to the particular floor.

An apparatus for elevator group control according to the second aspect of the present invention is characterized in that;

an apparatus for elevator group control, in which a plurality of elevator cars are operated between a plurality of floors, and one of said plurality of elevator cars is allocated to respond to a hall call generated by passengers on each floor, comprises:

operational state detecting means for detecting operational stages of said elevator cars;

traffic demand concentration determining means for determining, on the basis of the detection result of said operational state detecting means, whether destination floors of passengers are concentrated on a particular floor;

low service quality floor detecting means for extracting, when said traffic demand concentration determining means determines that a traffic demand is concentrated, a floor at which service quality for passengers is lowered, and determining said extracted floor as a low service quality floor;

elevator responding means for causing an elevator car, which is allocated to said low service quality floor determined by said low service quality floor detecting means, to respond to said low service quality floor when said elevator car operates in a direction opposite to said particular floor;

bidirectional call detecting means for detecting the presence of a hall call, in a direction opposite to said particular floor, on said low service quality floor; and elevator informing means for causing, when a hall call in a direction opposite to said particular floor is present, a hall indicator of an elevator car, allocated to said low service quality floor, to perform indication in a form different from an ordinary form, and giving guide information for indicating an elevator car operation direction or for guiding passengers upon opening of an elevator door.

In the arrangement corresponding to the second aspect of the present invention, the operational state detection unit performs operation state detection for each elevator car. If it is determined on the basis of the detection that the operational state exceeds a predetermined level, the traffic demand concentration determination unit determines whether destination floors of passengers are concentrated on a particular floor.

If the traffic demand concentration determination unit determines that the destination floors of the passengers are concentrated, 1) the low service quality floor detection unit extracts and determines, from allocated calls, a floor at which service quality for passengers is reduced, 2) the elevator response unit causes an elevator car allocated to the low service quality floor to respond to the floor when the elevator car operates in a direction opposite to the particular floor, 3) the bidirectional call detection unit detects that no hall call in a direction opposite to the particular floor is present on the low service quality floor, and 4) if a hall call in the opposite direction is present, the bidirectional call detection unit causes the elevator information unit to turn on a hall indicator in a way different from an ordinary way to guide waiting passengers upon opening of the door of an elevator car.

An apparatus for elevator group control according to the third aspect of the present invention is characterized in that;

an apparatus for elevator group control, in which a plurality of elevator cars are operated between a plurality of floors, and one of said plurality of elevator cars is allocated to respond to a hall call generated by passengers on each floor, comprises:

operational state detecting means for detecting operational states of said elevator cars;

traffic demand concentration determining means for determining, on the basis of the detection result of said operational state detecting means, whether destination floors of passengers are concentrated on a particular floor;

zoning control means for dividing, when said traffic demand concentration determining means determines that a traffic demand is concentrated, service floors into a plurality of service zones in accordance with the number of elevator cars, and causing said elevator cars to respond to said floors in units of said divided zones;

elevator responding means for causing an elevator car, allocated to a floor determined by said zoning control means, to respond to said floor when said elevator car operates in both directions to said particular floor and opposite to said particular floor; and zone cycle control means for equally circulating floors to be responded, of floors determined by said zoning control means, with respect to said elevator responding means.

In the arrangement corresponding to the third aspect of the present invention, the operational state detection unit performs operational state detection for each elevator car. If it is determined on the basis of the detection that the operational state exceeds a predetermined level, the traffic demand determination unit determines whether destination floors of passengers are concentrated on a particular floor.

If the traffic demand concentration determination unit determines that the destination floors of the passengers are concentrated, 1) the zoning control unit zones the floors by the number of elevator cars, 2) the response elevator car allocation unit causes each elevator car to respond when the elevator car operates in a direction opposite to the particular floor, and 3) the zone cycle control unit circulates a response floor in each zone such that elevator cars equally respond to floors in the zone.

According to the present invention as described above, there is provided an apparatus for elevator group control, which can maintain a high transportation efficiency and equalize service quality between floors when destination floors of passengers are concentrated on a particular floor.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described below with reference to the accompanying drawings.

The first embodiment of the present invention will be described below with reference to FIGS. 2 to 12.

Figure 1:
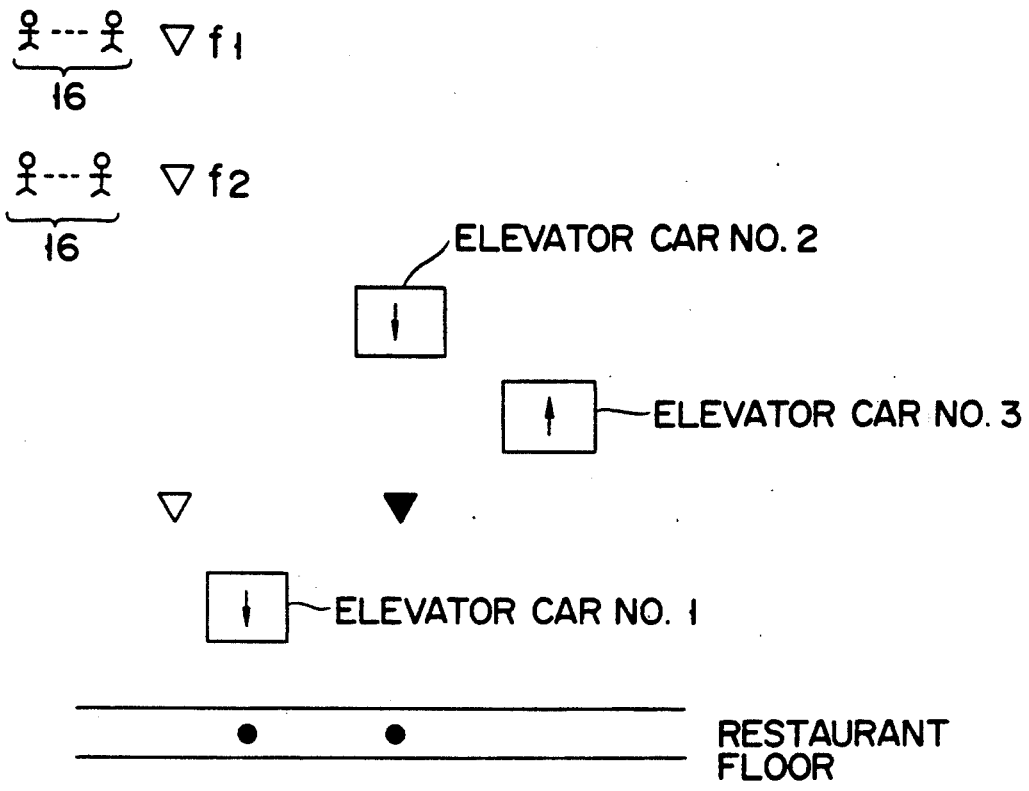
FIG. 1 (PRIOR ART)
FIG. 1 is a view for explaining a schematic operation of a conventional apparatus for elevator group control.
Figure 2:
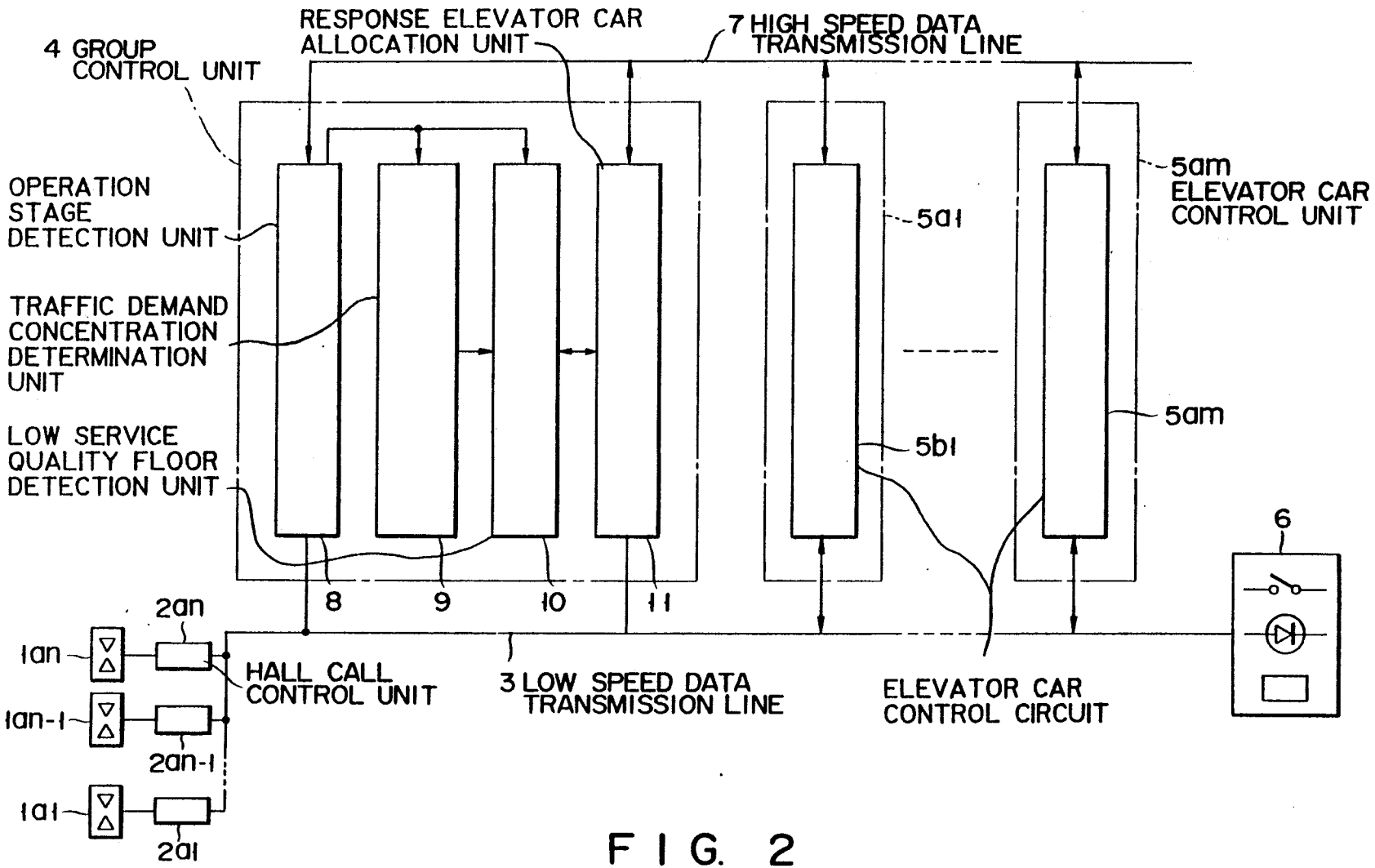
FIG. 2 is a block diagram showing a schematic arrangement of the first embodiment of the present invention.

FIG. 2 is a block diagram showing an arrangement of a main part of this embodiment. An apparatus of this embodiment basically comprises a group control unit 4 and an elevator car control unit 5. The group control unit 4 incorporates an operational state detection unit 8, a traffic demand concentration determination unit 9, a low service quality floor detection unit 10, and a response elevator car allocation unit 11. The operational state detection unit 8 detects operational states of elevator cars, e.g., the contents of call registration in individual elevator cars from elevator car control circuits $5_{bl}$ to $5_{bm}$ in elevator car control units $5_{al}$ to $5_{am}$ via low and high speed data transmission lines 3 and 7.

A detection signal detected by the operation state detection unit 8 is transmitted to the traffic demand determination unit 9 and the low service quality floor detection unit 10. Upon receiving the detection signal transmitted from the operation state detection unit 8, the traffic demand concentration determination unit 9 determines whether destination floors of passengers are concentrated on a particular floor, e.g., whether the number of passengers getting off at a particular floor is large or not. After the traffic demand concentration determination unit 9 determines the traffic demand concentration, a signal from the traffic demand concentration determination unit 9 is transmitted to the low service quality floor detection unit 10. The lower service quality floor detection unit 10 detects and determines, from allocated calls, a floor at which service quality for passengers is reduced, e.g., a floor at which a duration of a hall call is a predetermined value or more.

A signal transmitted from the traffic demand concentration determination unit 9 to the low service quality floor detection unit 10 is transmitted to the response elevator car allocation unit 11 via the low service quality floor detection unit 10.

The response elevator car allocation unit 11 can exchange signals with the elevator car control circuits $5_{bl}$ to $5_{bm}$ via the high speed data transmission line 7, and can exchange signals with hall call control units $2_{al}$ to $2_{an}$ and a monitor panel 6 via the low speed data transmission line 3.

An operation of FIG. 2 will be described below with reference to FIGS. 3A to 3D for explaining a schematic operation and flow charts of FIGS. 4 to 12. FIGS. 3A to 3D show a case wherein an elevator car 15 allocated to floors $f_1$, $f_2$, and $f_3$ upon starting from a particular floor performs an opposite-direction response to the floor $f_3$ which is detected to be a low service quality floor.

Figure 4:
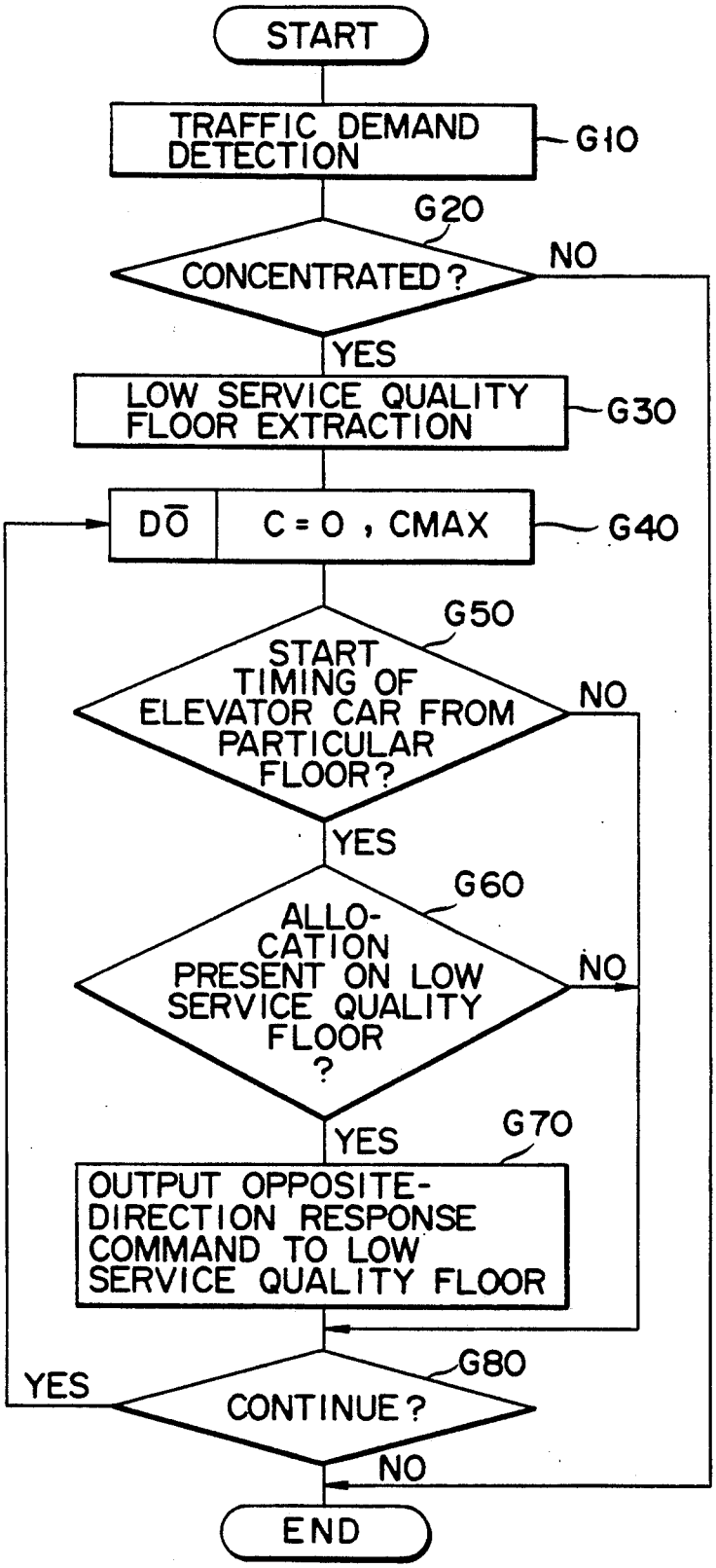
FIG. 4 is a flow chart for explaining an entire schematic operation of FIG. 2.

Referring to FIG. 4, the operational state detection unit 8 detects operational states of individual elevator cars (i.e., a traffic demand) from the elevator car control circuits $5_{bl}$ to $5_{bm}$ and the hall call control units $2_{al}$ to $2_{an}$ (step G10). The traffic demand concentration determination unit 9 determines on the basis of the detection whether destination floors of passengers on respective floors are concentrated at a predetermined level or more on a particular floor such as a restaurant floor (step G20), where the determination conditions are, for example, whether each of a hall call direction and elevator car call registration from an individual floor for the particular floor is a predetermined ratio or more and whether an average arrival load to the particular floor exceeds, e.g., 70%.

If the traffic demand concentration determination unit 9 determines the traffic demand concentration, the low service quality floor detection unit 10 performs determination of a low service quality floor (to be described later) (step G30).

Figures 3A, 3B, 3C, 3D:
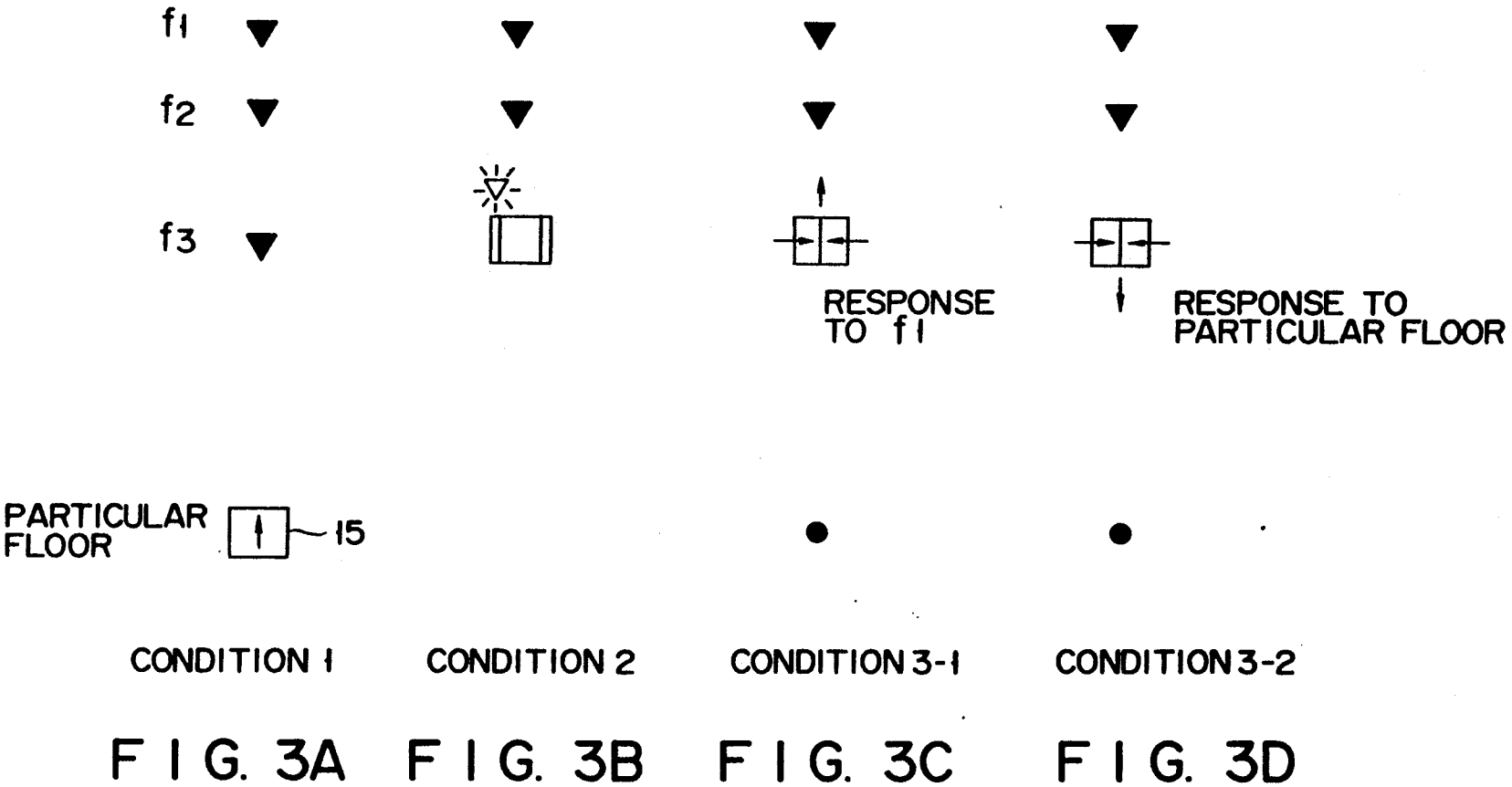
FIGS. 3A to 3D are views for explaining a schematic operation of FIG. 2.

From a condition 1 shown in FIG. 3A, the response elevator car allocation unit 11 determines on the basis of each elevator car information whether the elevator car 15 starts from the particular floor or not (step G50). If a hall call is from a low service quality floor (step G60), the response elevator car allocation unit 11 sends an opposite-direction response command to an allocated elevator car for the hall call (step G70), thereby executing, together with the elevator car control circuit $5_{bl}$, an opposite-direction response function for the low service quality floor. More specifically, when an elevator car operates in an opposite direction (UP) to the floor $f_3$ as the allocated low service quality floor, the response elevator car allocation unit 11 sends a command to the elevator car to respond to a DOWN call of the floor $f_3$. Steps G50 to G70 are performed for all the elevator cars 15 (steps G40 and G80).

An operation of the elevator car control unit 5 will be described below with reference to FIG. 5.

The elevator car control unit 5 al executes an operation corresponding to an opposite-direction response command supplied from the response elevator car allocation unit 11. As shown in FIG. 3B, when an elevator car operates in an opposite direction, i.e., an UP direction to the floor $f_3$, the elevator car control unit $5_{al}$ performs elevator car deceleration (step S10). In this case, the elevator car control unit $5_{al}$ erases a DOWN call of the floor $f_3$ (steps S20 and S30) and flickers a lantern indicating DOWN, thereby giving opposite-direction arrival information (step S40). After passengers on the floor $f_3$ get on the elevator car, the elevator car control unit $5_{al}$ selects a direction at an elevator car start timing (step S50). If the elevator car loading capacity is reached upon passenger boarding on the floor $f_3$ (step S60) and no intraelevator car destination call (elevator car call) is present in an elevator car operation direction (UP) (step S70), selection for the elevator car operation direction (UP) need not be performed. Therefore, as shown in FIG. 3D, a direction to the particular floor is selected (step S80). Otherwise, the direction is kept in the elevator car operation direction (UP), and a response is performed for a floor designated by an intra-elevator car destination call or the floor $f_1$ (step S90), as shown in FIG. 3C.

In the condition 2 shown in FIG. 3B, guide information indicating the direction to the particular floor was given to the passengers on the floor $f_3$ by flickering of the hall lantern. Therefore, intraelevator car guide information indicating "this elevator car temporarily goes up" is given by a voice or a display (step S100). In this step, confusion among the passengers from the floor $f_3$ can be prevented by informing that the elevator car is in a special operation state.

The low service quality floor determination unit in step G30 of FIG. 4 will be described below with reference to the flow chart shown in FIG. 6.

An all-floor hall index $H_{max}$ having two hall indexes of one-floor UP and DOWN is determined from the response elevator car allocation unit 11 (step C110).

On the basis of elevator car information transmitted from the elevator car control units $5_{al}$ to $5_{am}$ to the response elevator car allocation unit 11 of the group control unit 4 through the low speed data transmission line 3, the low service quality floor detection unit 10 detects low service quality floors in the following way. When an elevator car moves to a given floor in response to a hall call from that floor, it may be the case that the elevator becomes filled to its maximum capacity after picking up the passengers at the given floor. If so, in step C130, the low service quality floor detection unit 10 detects this situation and then determines if the direction in which the elevator is heading is toward a particular floor at which traffic demands are concentrated. If it is, the given floor is determined to be a low service quality floor, in step C140.

According to the first embodiment of the present invention as described above, when passengers are to be carried to a particular floor such as a restaurant floor in a special time period such as the first half of a lunch break, service quality can be equalized between floors.

Figure 6:
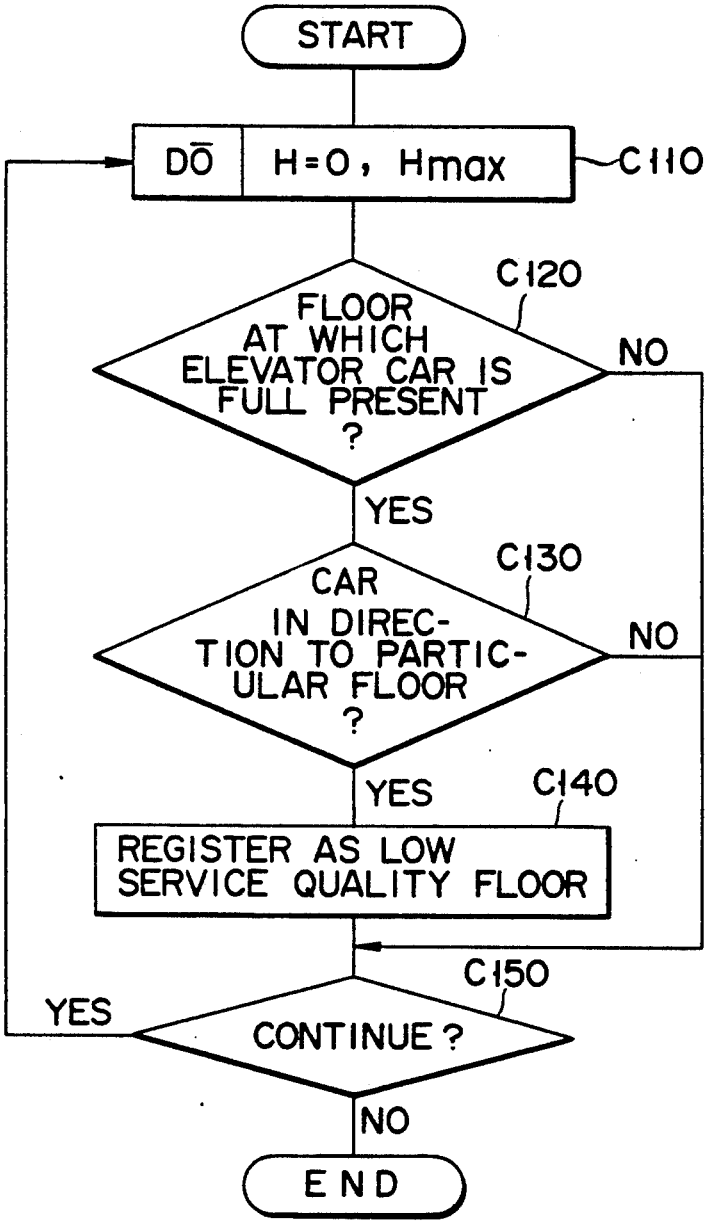
FIG. 6 is a flow chart for explaining an operation of a low service quality floor determination method shown in FIG. 2.

In the flow chart shown in FIG. 6, a floor from which an elevator car starts full of passengers in a direction to a particular floor immediately preceding stopping of the car is exemplified as a determination condition for registering a low service quality floor. However, the following items can be similarly applied as other determination conditions.

(1) A hall call allocated floor passed by an elevator car full of passengers.

(2) A floor at which a hall call elapsed time is a predetermined time or more.

(3) A floor at which a predicted nonresponse time is a predetermined time or more.

(4) A floor having a maximum nonresponse time of hall call allocated floors of an elevator car operating in a direction to a particular floor.

(5) A floor at which the number of passengers capable of getting on is a predetermined value or less immediately preceding stopping of the car.

(6) A floor at which a boarding accumulated value ratio of the floor in a predetermined time period is lower than a boarding queue based on past statistical data.

Examples of practicing low service quality floor registration will be described in detail below in accordance with the above determination conditions (1) to (6). An operation except for the low service quality floor determination method is similar to that shown in FIG. 4 and therefore will be omitted. The low service quality floor determination is performed by the response elevator car allocation unit 11 of the group control unit 4 on the basis of various information of individual elevator cars input with a predetermined time interval from the elevator car control units $5_{al}$ to $5_{am}$ through the low speed data transmission line 3.

(1) A hall call allocated floor passed by an elevator car full of passengers.

Figure 7:
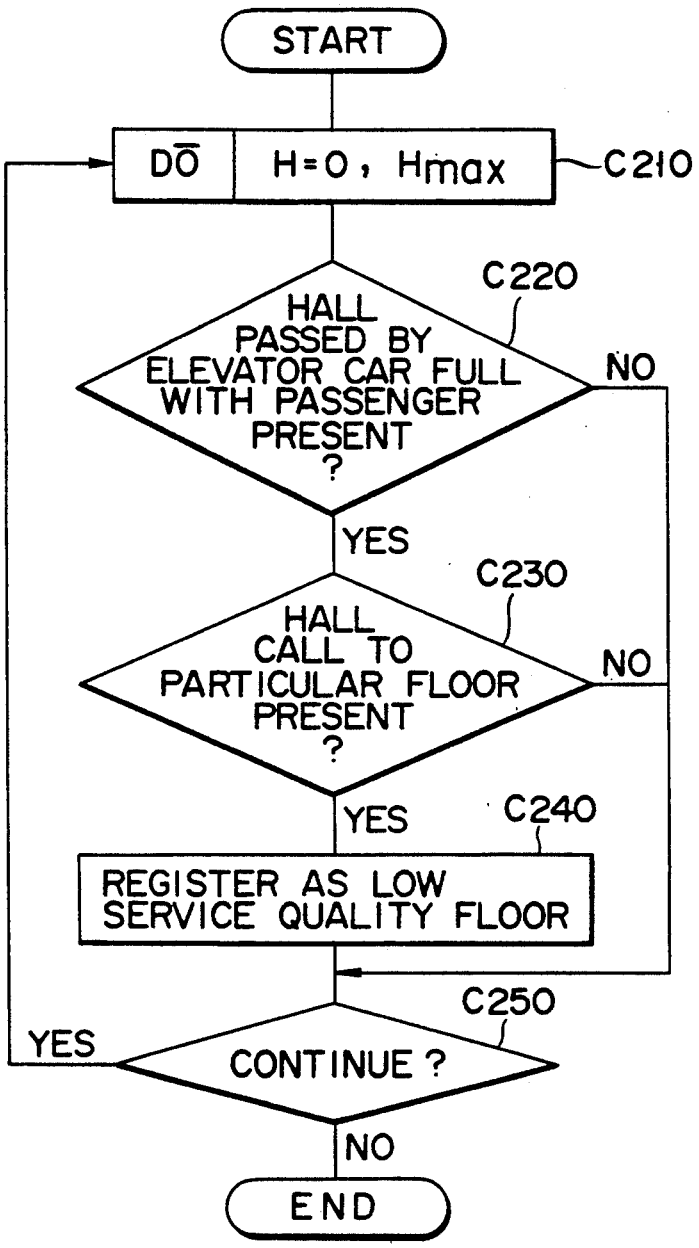
FIG. 7 is a flow chart showing the first modification of the low service quality floor determination method in FIG. 2.

As a determination condition, a method of determining a low service quality floor using a hall call allocated floor passed by an elevator car full of passengers will be described below with reference to FIG. 7.

On the basis of elevator car information transmitted from the elevator car control units $5_{al}$ to $5_{am}$ to the response elevator car allocation unit 11, the low service quality floor detection unit 10 detects a hall at which an elevator car is full with passengers for all of the hall indexes (step C220). If a corresponding hall is detected, the low service quality floor detection unit 10 extracts a particular floor from registered hall calls after the above hall, i.e., a hall call allocated floor passed by an elevator car having a full of passengers (step C230), and registers the extracted floor as a low service quality floor (step C240). The extraction of a low service quality floor is performed for all of the hall indexes (steps C250 and C210).

(2) A floor at which a hall call elapsed time is a predetermined time or more

Figure 8:
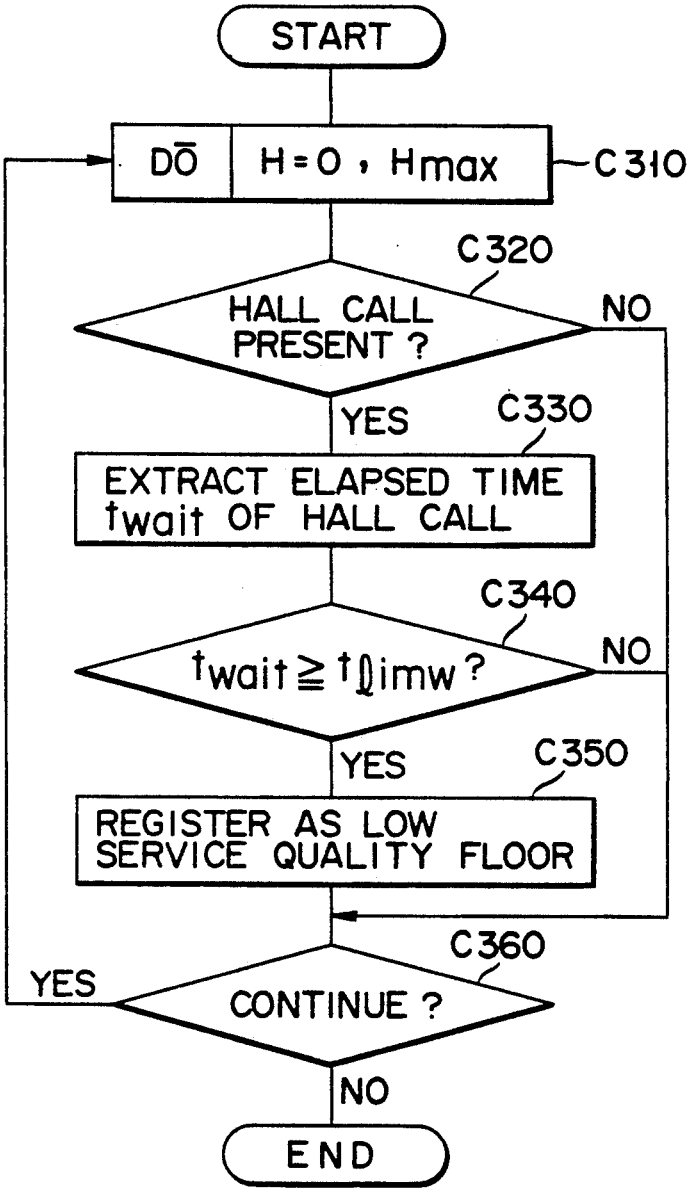
FIG. 8 is a flow chart showing the second modification of the low service quality floor determination method in FIG. 2.

As a determination condition, a method of determining a low service quality floor using a floor at which a hall call elapsed time is a predetermined time or more as a determination condition will be described below with reference to the flow chart shown in FIG. 8. When a hall call transmitted from the hall call control units $2_{al}$ to $2_{an}$ shown in FIG. 2 through the low speed data transmission line 3 is registered (step C320), the low service quality floor detection unit 10 counts an elapsed time from the registration timing and extracts an elapsed time $t_{wait}$ from all the hall indexes (step C330). If the elapsed time $t_{wait}$ is a predetermined time $t_{limw}$ or more (step d340), the low service quality floor detection unit 10 extracts a floor having the above call as a low service quality floor and determines the extracted floor as a low service quality floor (step 350). The extraction of a low service quality floor is performed for all the hall indexes (steps C360 and C310).

(3) A floor at which a predicted nonresponse time is a predetermined time or more.

Figure 9:
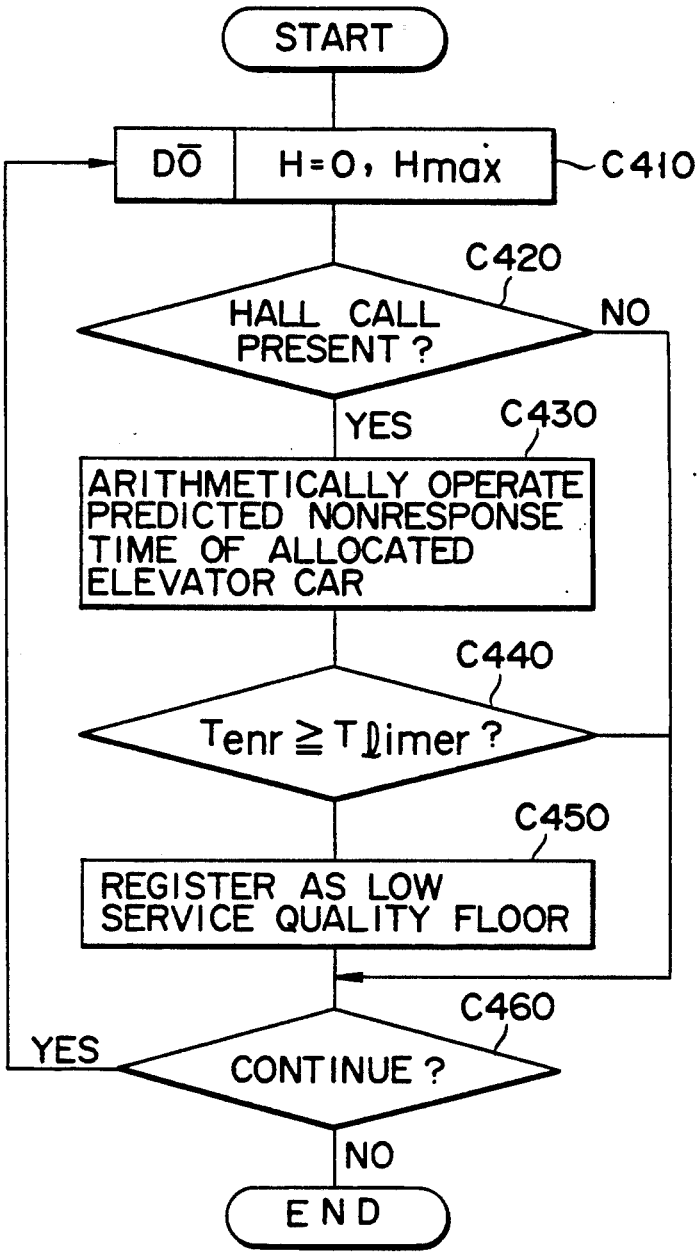
FIG. 9 is a flow chart showing the third modification of the low service quality floor determination method in FIG. 2.

As a determination condition, a method of determining a low service quality floor using a floor at which a predicted nonresponse time is a predetermined time or more as a determination condition will be described below with reference to the flow chart shown in FIG. 9.

On the basis of elevator car information transmitted from the elevator car control units $5_{al}$ to $5_{am}$, the response elevator car allocation unit 11 calculates a predicted arrival time of an elevator car corresponding to a call. For a hall having a hall call of all the hall indexes (step C420), the low service quality floor detection unit 10 arithmetically operates a predicted nonresponse time $t_{enr}$ with respect to the call on the basis of a hall call elapsed time with reference to the predicted nonresponse time calculated by the response elevator car allocation unit 11 (step C430). If the predicted nonresponse time is a predetermined time $t_{limer}$ or more (step C440), the low service quality floor detection unit 10 extracts floor having the above call as a low service quality floor and determines the extracted floor as a low service quality floor (step C450). The extraction of a low service quality floor is performed for all the hall indexes (steps C460 and C410). Where, the predicted nonresponse time is obtained by a sum of an elapsed time (t1) from a hall call generation timing and a predicted arrival time (t2) to arrival of an elevator car allocated to the hall call at the hall call floor.

Figure 10:
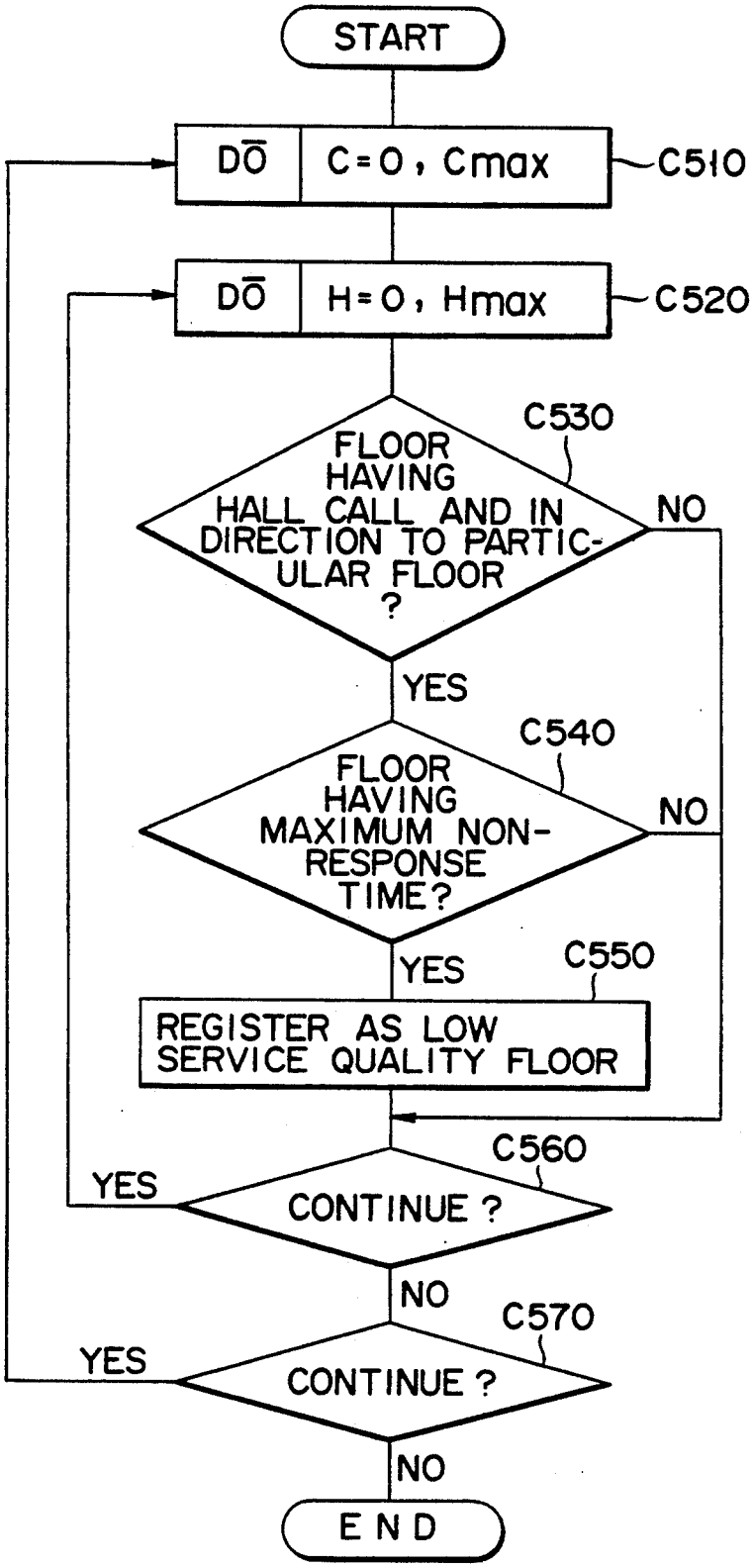
FIG. 10 is a flow chart showing the fourth modification of the low service quality floor determination method in FIG. 2.

(4) A floor having a maximum nonresponse time of hall call allocated floors of an elevator car operating in a direction to a particular floor As a determination condition, a method of determining a low service quality floor using a floor having a maximum nonresponse time of hall call allocated floors of an elevator car operating in a direction to a particular floor as a determination condition will be described below with reference to the flow chart shown in FIG. 10.

On the basis of elevator car information transmitted from the elevator car control units $5_{al}$ to $5_{am}$, the response elevator car allocation unit 11 calculates a nonresponse time (an elapsed time from generation of a hall call) of a floor which has a hall call and at which an allocated elevator car does not arrive yet. For all the hall indexes of elevator cars, the low service quality floor detection unit 10 extracts floors in a direction toward a particular floor from floors having hall calls (step C530). Subsequently, the low service quality floor detection unit 10 extracts a floor having a maximum nonresponse time of nonresponse times in units of halls of the above extracted floors (step C540) and determines the extracted floor as a low service quality floor (step C550). The extraction of a low service quality floor is performed for all the elevator cars and all the hall indexes (steps C570 and C510, and steps C560 and C520).

(5) A floor at which the number of passengers capable of getting on is a predetermined value or less immediately preceding stopping of the car.

Figure 11:
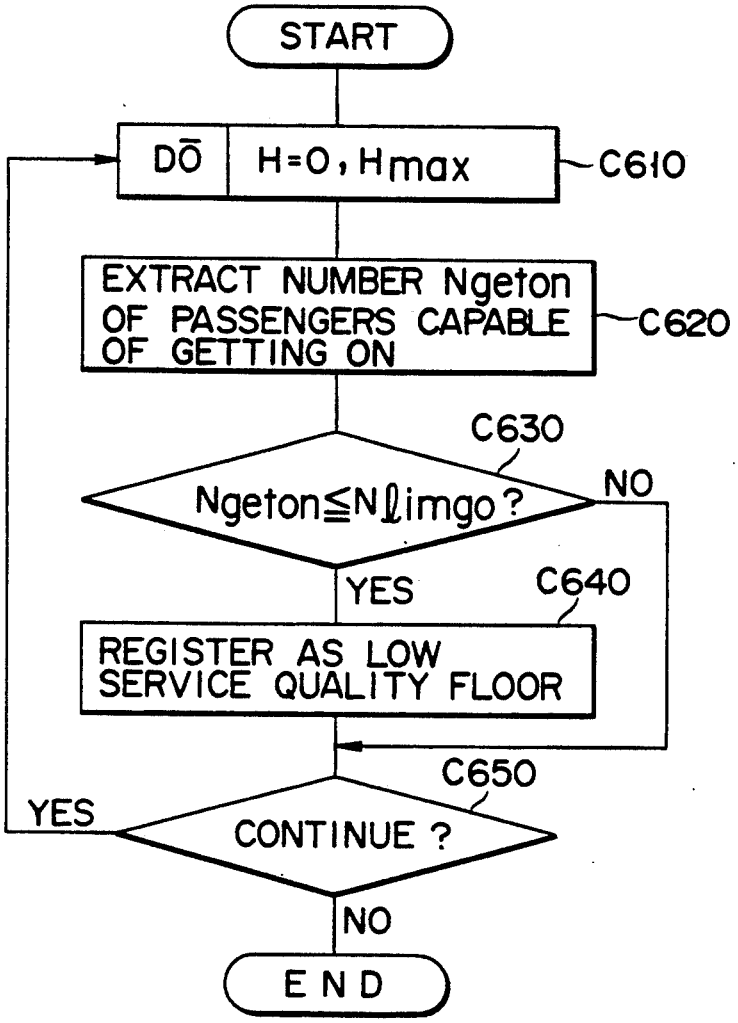
FIG. 11 is a flow chart showing the fifth modification of the low service quality floor determination method in FIG. 2.

As a determination condition, a method of determining a low service quality floor using a floor at which the number of passengers capable of getting on is a predetermined value or less immediately preceding stoppage as a determination condition will be described below with reference to the flow chart shown in FIG. 11.

On the basis of elevator car information transmitted from the elevator car control units $5_{al}$ to $5_{am}$, the response elevator car allocation unit 11 calculates the number of passengers capable of getting on in accordance with an on board load upon stoppage of each elevator car and sets the number of passengers capable of getting on of each hall index at a predetermined value. The low service quality detection unit 10 extracts the number $N_{geton}$ of passengers capable of getting on in units of halls calculated by the response elevator car allocation unit 11 (step C620). The low service quality floor detection unit 10 extracts a floor having a predetermined value $N_{limgo}$ or less from the halls (step C630), and determines the extracted floor as a low service quality floor (step C640). The extraction of a low service quality floor is performed for all the hall indexes (steps C650 and C610).

(6) A floor at which a boarding accumulated value ratio of the floor in a predetermined time period is lower than a boarding queue based on past statistical data.

Figure 12:
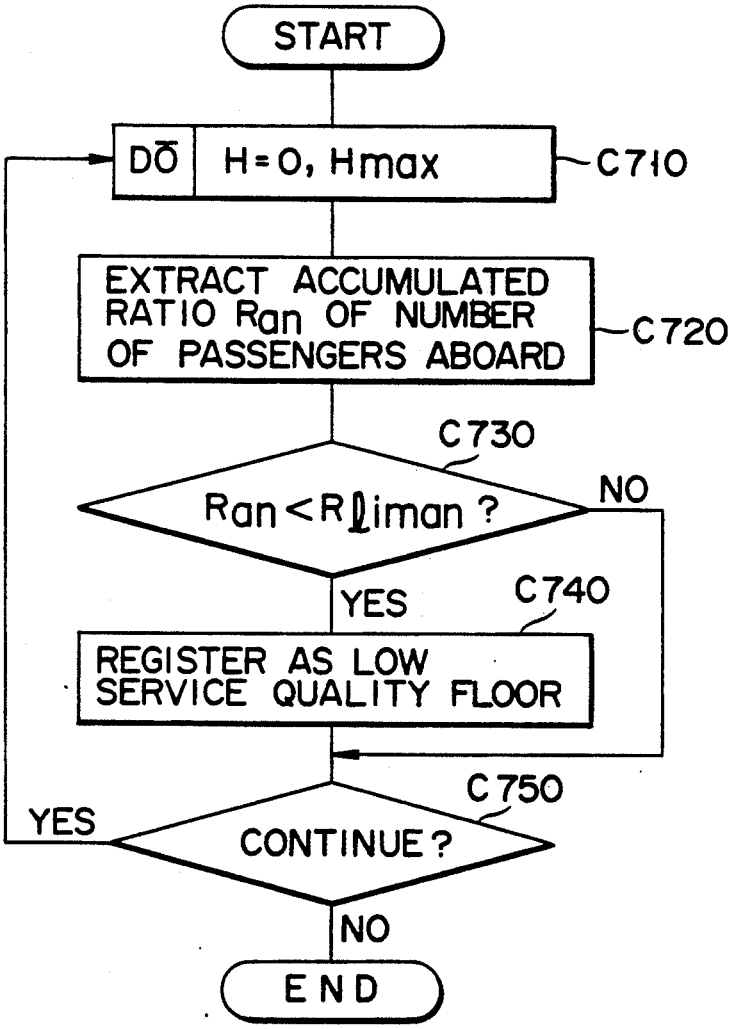
FIG. 12 is a flow chart showing the sixth modification of the low service quality floor determination method in FIG. 2.

As a determination condition, a method of determining a low service quality floor using a floor at which a boarding accumulated value ratio of the floor in a predetermined time period is lower than a boarding queue based on past statistical data as a determination condition will be described below with reference to the flow chart shown in FIG. 12.

On the basis of information transmitted from the elevator car control units $5_{al}$ to $5_{am}$, the response elevator car allocation unit 11 constantly calculates an accumulated value of the number of passengers for each floor. The response elevator car allocation unit 11 calculates an accumulated ratio $R_{an}$ of the number of passengers (which may be an accumulated value of the number of passengers) to a boarding queue of each floor on the basis of past statistical data (step C720). with reference to the boarding accumulated ratio $R_{an}$ calculated by the response elevator car allocation unit 11, the low service quality floor detection unit 10 extract a floor at which the accumulated ratio is a predetermined value $R_{liman}$ or less as a low service quality floor (step C730), and determines the extracted floor as a low service quality floor (step C740). The extraction of a low service quality floor is performed for all the hall indexes (steps C750 and C710).

The second embodiment of the present invention will be described below with reference to FIGS. 13 to 19B.

Figure 13:
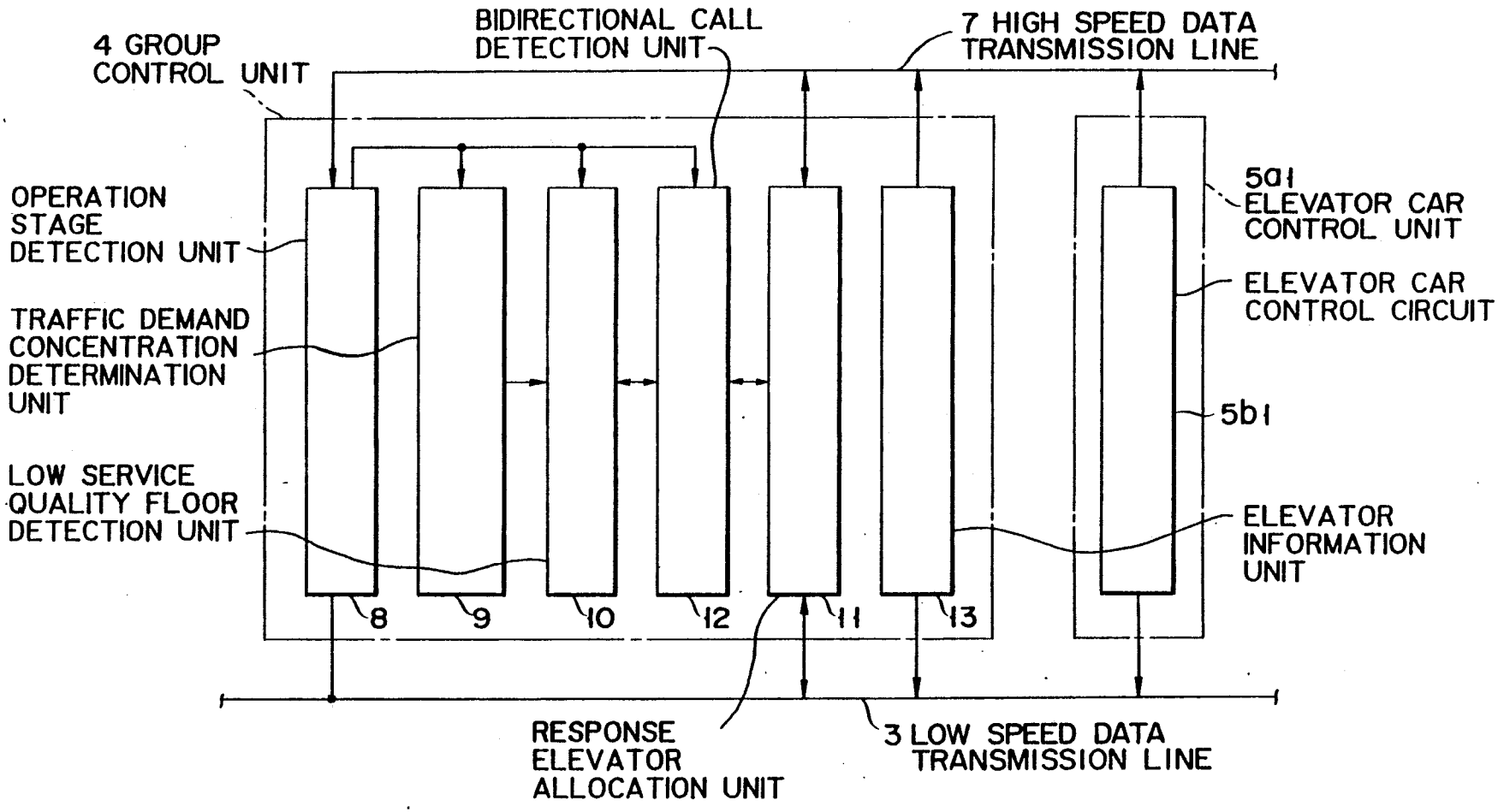
FIG. 13 is a block diagram showing a schematic arrangement of the second embodiment of the present invention.

FIG. 13 shows a group control unit 4 and an elevator car control unit 5, in which the same reference numerals as in FIG. 2 denote the same parts.

The second embodiment is different from the first embodiment in that a bidirectional call detection unit 12 is further incorporated in the group control unit 4.

The bidirectional call detection unit 12 detects whether hall calls are present in a low service quality direction and an opposite direction at a service floor. An elevator information unit 13 causes a hall lantern (not shown) to indicate a state different from an ordinary state, e.g., flickers it in both directions, and informs an operation direction of an elevator car upon opening of a door of the elevator car.

Figures 14A, 14B, 14C:
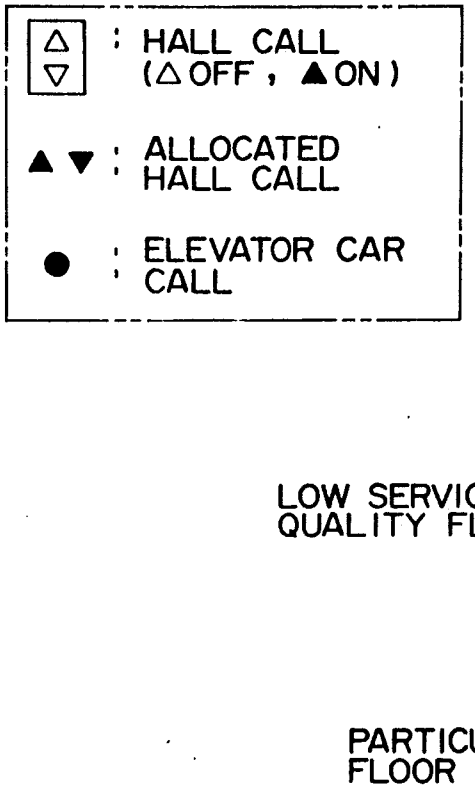
FIGS. 14A to 14C are views for explaining a schematic operation of the second embodiment of the present invention.

FIG. 14A is a view for explaining an operation of this embodiment. FIG. 14A illustrates a case wherein hall calls are generated on floors $f_1$, $f_2$, and $f_3$, the floor $f_3$ is a low service quality floor, and calls in both up and down directions are generated on the floor $f_3$.

Figure 15A:
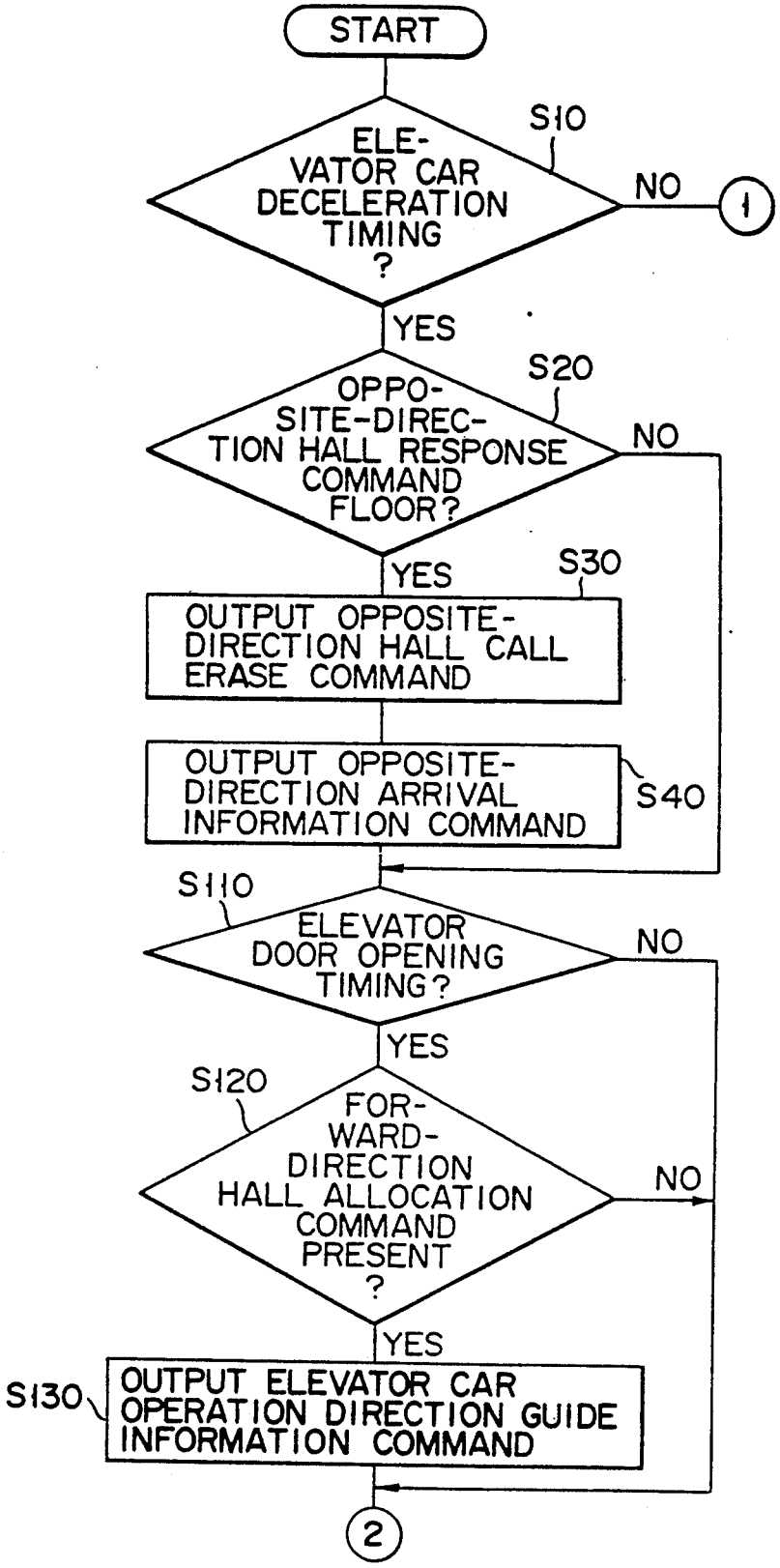
FIGS. 15A and 15B are flow charts for explaining an operation of FIG. 14.
Figure 15B:
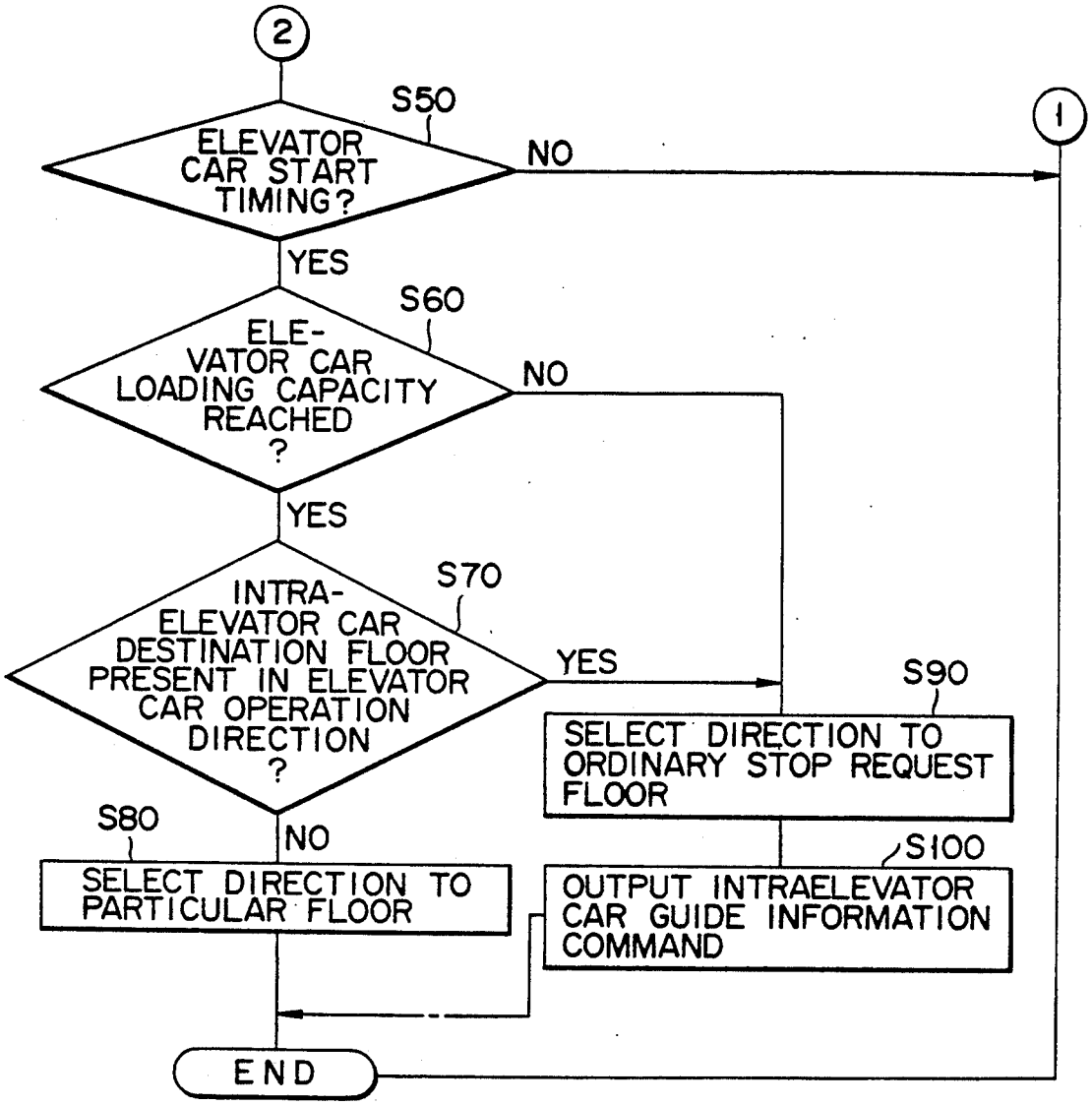

An elevator car control unit $5_{al}$ executes the following operations in accordance with a flow chart shown in FIGS. 15A and 15B. The same reference symbols as in FIG. 5 of the first embodiment denote the same operation and a detailed description thereof will be omitted.

Figure 5:
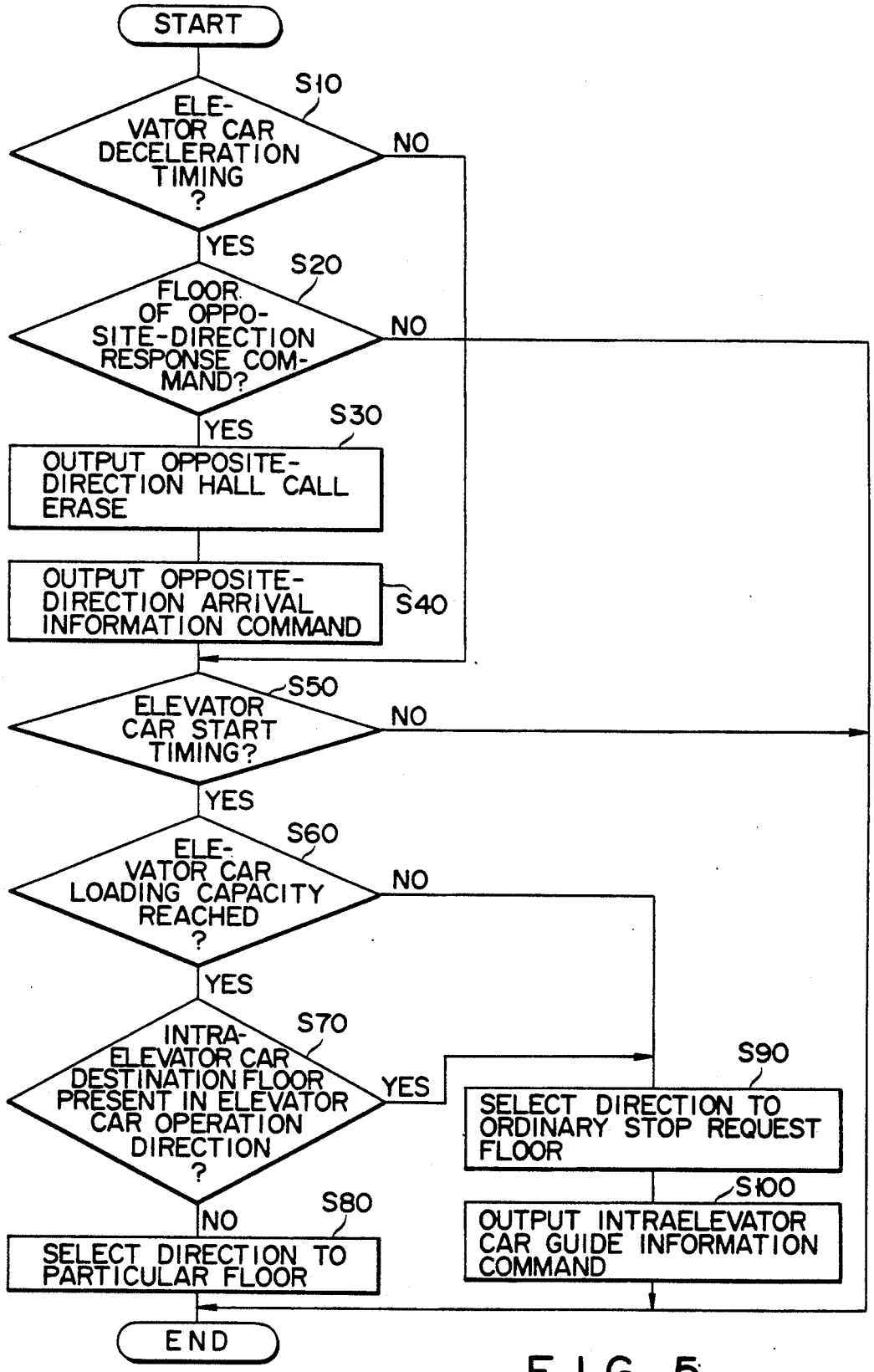
FIG. 5 is a flow chart for explaining an operation of an elevator car control unit shown in FIG. 2.

Steps S10 to S40 in FIG. 15A are the same as those in FIG. 5 and therefore a detailed description thereof will be omitted. In step S40 of this embodiment, however, since an UP hall call is present on the floor $f_3$, an UP hall lantern is simultaneously flickered and the UP hall call is erased by ordinary response processing in step S30. Therefore, as shown in FIG. 14B, both the UP and DOWN hall lanterns are flickered, and both the UP and DOWN hall calls are erased.

As described above, since the hall lanterns in both the directions are flickered for passengers in the hall at an opening timing of an elevator door (step S110), an operation direction of the elevator car is unknown. Therefore, if a forward-direction hall allocation command is present (step S120), a guide information command for informing the operation direction of the elevator car is executed (step S130). Examples of voice information for executing this guide information command are "this elevator car is going up" and "down passengers are also welcomed".

In steps S120 and S130, passengers heading for both the directions in the hall of the floor $f_3$ are guided by the hall lanterns. The passengers can also recognize the operation direction of an elevator car. Therefore, although the guidance is different from an ordinary one, the passengers can get on an elevator car without being confused.

After the passengers get on an elevator car from the floor $f_3$, a direction is selected at a start timing of the elevator car (step S50). If an elevator car loading capacity is reached upon boarding on the floor $f_3$ and no intraelevator car destination call (elevator car call) is present in the elevator car operation direction (UP) (step S70), selection for the elevator car operation direction (UP) need not be performed. Therefore, a direction to a particular floor is selected (step S80). Otherwise, the direction is kept in the elevator car operation direction (UP), and a response is performed for a floor corresponding to an intraelevator car destination call or the floor $f_1$ (step S90), as shown in FIG. 14C.

In step S90, if a condition 2 in FIG. 14B is set for the passengers on the floor $f_3$, guide information indicating the direction to a particular floor is performed by flickering the hall lantern. That is, intraelevator car guide information indicating "this elevator car temporarily goes up" is given by a voice or a display (step S100) to inform the passengers from the floor $f_3$ of that the elevator car is in a special operation state, thereby preventing them from being confused.

According to the second embodiment as described above, when passengers are to be carried to a particular floor such as a restaurant floor in a special time period such as the first half of a lunch break, service quality can be equalized between floors and a transportation efficiency to the restaurant floor can be increased without lowering convenience in use of passengers waiting in halls.

Figure 16A:
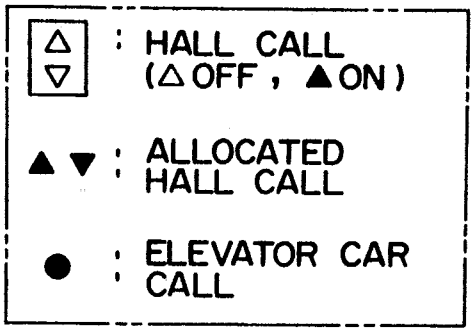
FIGS. 16A to 16C are views for explaining a schematic operation of the first modification of the second embodiment according to the present invention.

The first modification of the second embodiment of the present invention will be described below with reference to a view for explaining a schematic operation shown in FIG. 16 and a flow chart shown in FIGS. 17A and 17B, in which the same reference numerals as in the second embodiment denote the same parts and only the different portions will be described. In the second embodiment, when a hall call in a direction opposite to a particular floor is present, the elevator information unit 13 flickers hall lanterns in both directions of an elevator car allocated to a low service quality floor, and gives guide information indicating the operation direction of an elevator car upon opening of an elevator door. In this modification, however, when a hall call in a direction opposite to a particular floor is present with respect to an elevator car allocated to a low service quality floor, the elevator information unit 13 flickers only a hall lantern indicating the operation direction of an elevator car, and gives guide information for guiding passengers heading for a direction to a low service quality floor upon opening an elevator door.

The above operation is performed by another operation of the elevator car control unit $5_{al}$ corresponding to an opposite-direction response command by the response elevator car allocation unit 11 shown in FIG. 13. In a condition 2 shown in FIG. 16B, deceleration is performed with respect to the floor $f_3$ when an opposite direction, i.e., an UP direction is selected (step S10 in FIG. 17A). In this step, a DOWN call of the floor $f_3$ is erased (step S30). Since an UP hall call is also present on the floor $f_3$, the hall lantern indicating UP is flickered and the hall call in the UP direction is erased by ordinary response processing (step S30).

Figure 16B:
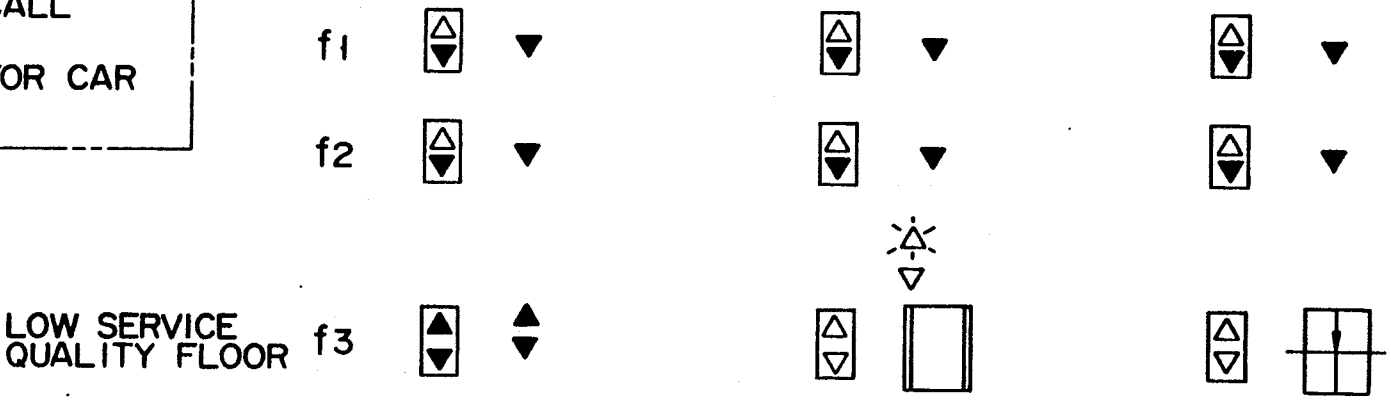
Figure 16C:
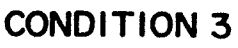
Figure 17A:
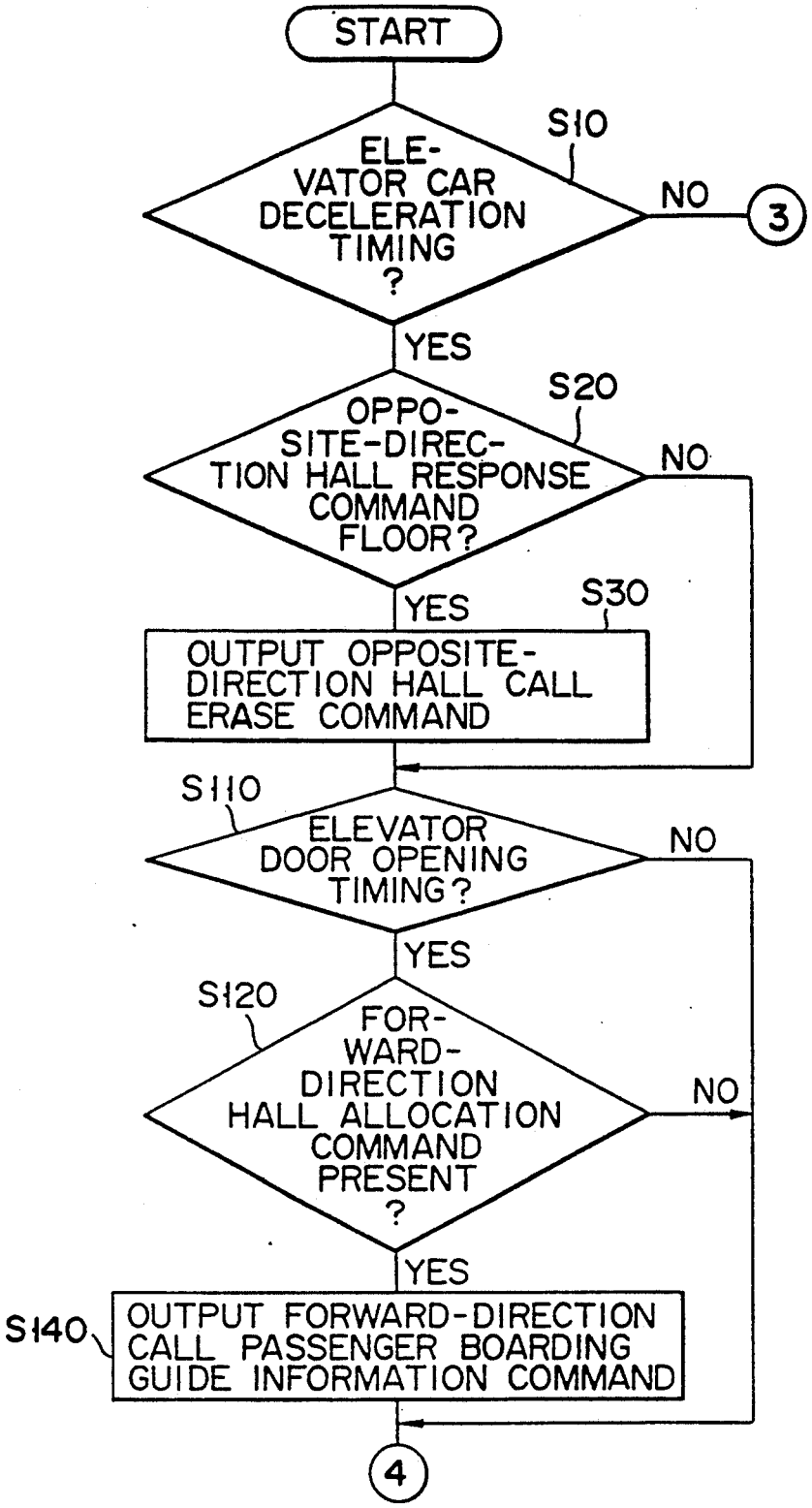
FIGS. 17A and 17B are flow charts for explaining an operation of FIG. 16.
Figure 17B:
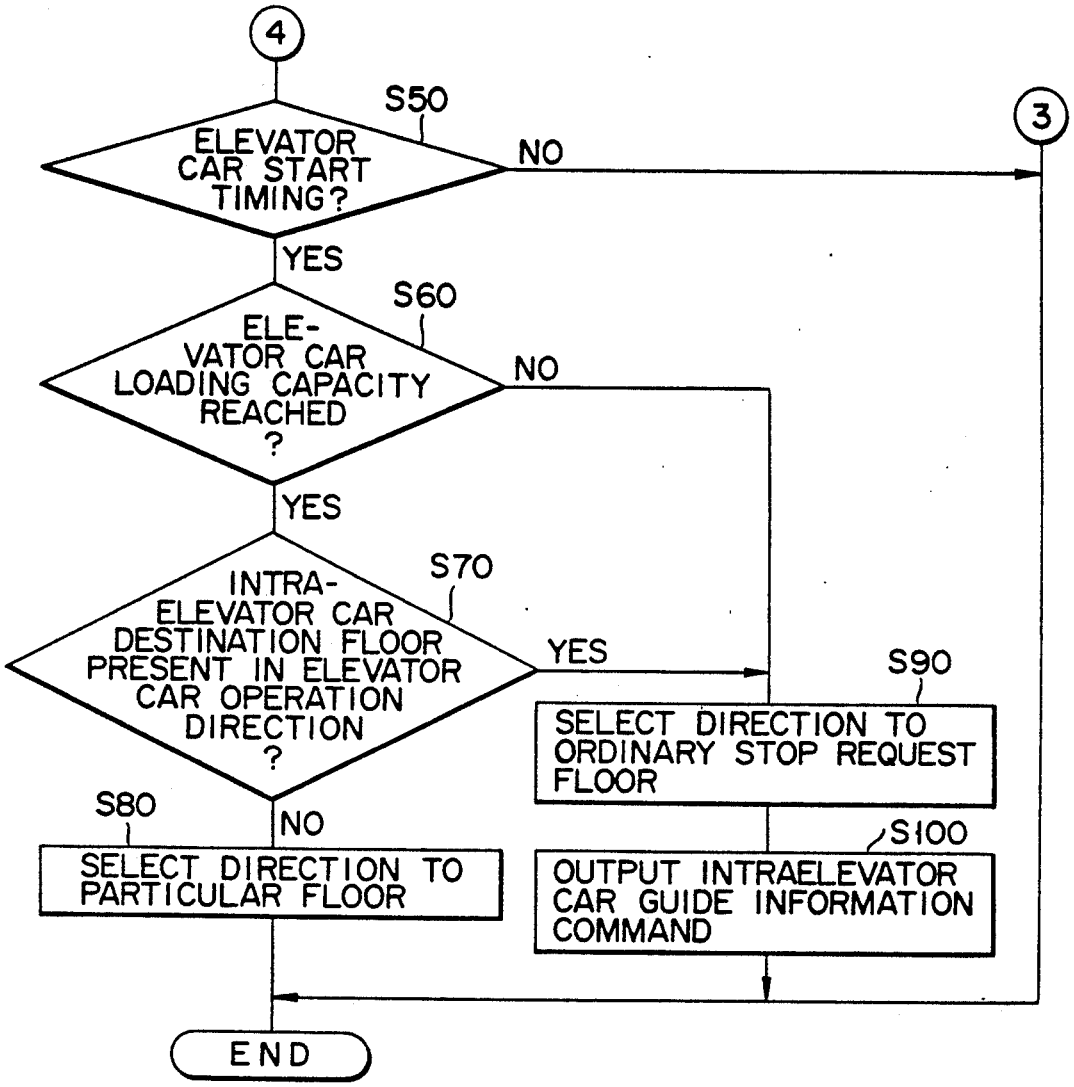

Therefore, as indicated by the condition 2 shown in FIG. 16B, the hall lantern indicating UP is flickered, and both the UP and DOWN hall calls are erased.

Since the hall lantern indicating UP is flickered for passengers in the hall at an opening timing of an elevator door (step S110), no passenger guidance is performed for passengers corresponding to a low service quality floor call, i.e., passengers heading for a DOWN direction. Therefore, if a forward direction hall allocation command is present (step S120), a guide information command for performing boarding guidance for the passengers heading for the DOWN direction (step S140). An example of this guide information command is "down passengers are also welcomed".

As described above, passengers heading for the DOWN direction in the hall of the floor $f_3$ can recognize boarding guidance of an elevator car by the boarding guide information given upon opening of an elevator door. Therefore, these passengers can get on an elevator car without being confused. An operation following the above operation is the same as that in the second embodiment.

Figures 18A, 18B, 18C:
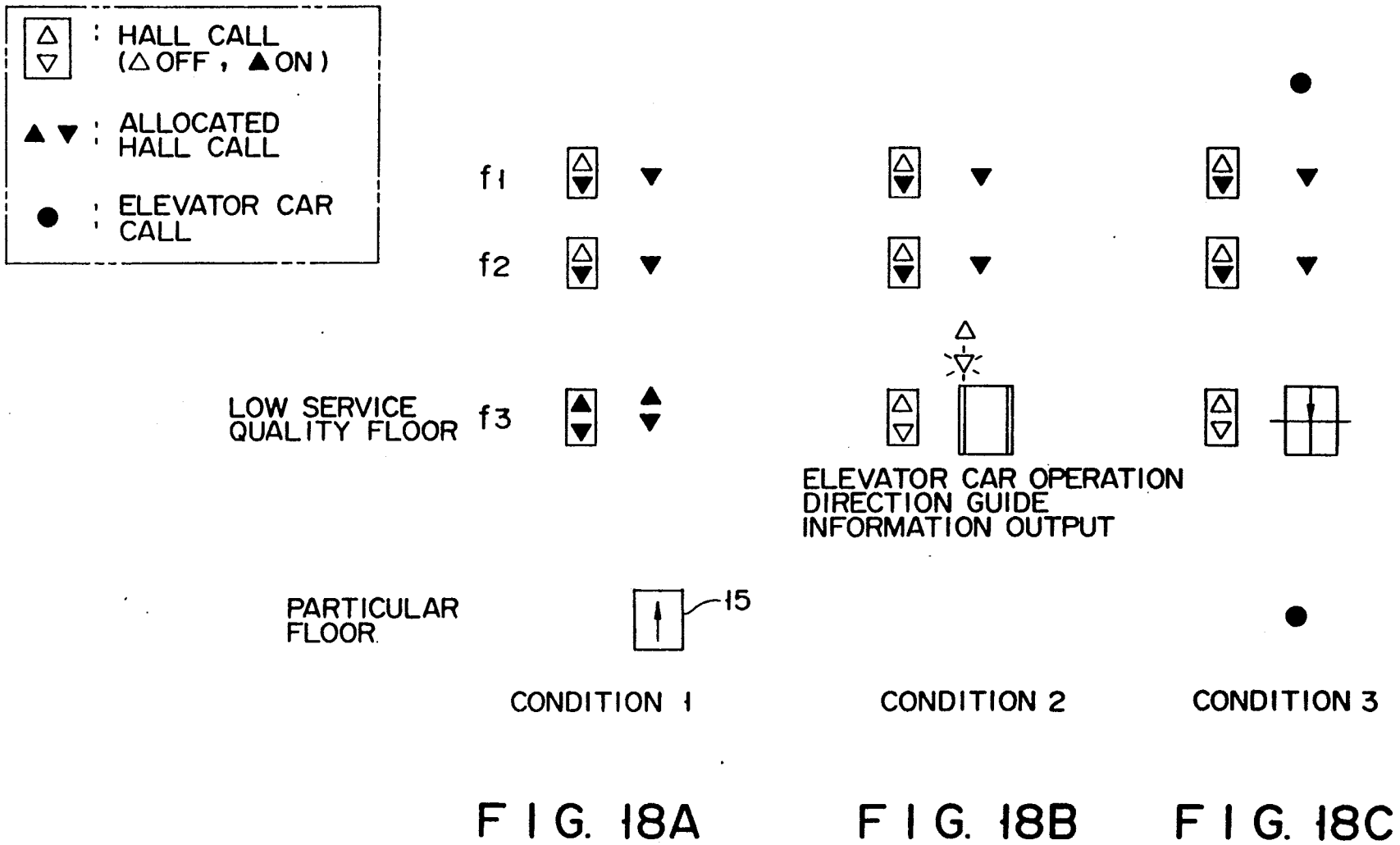
FIGS. 18A to 18C are views for explaining a schematic operation of the second modification of the second embodiment according to the present invention.
Figure 19A:
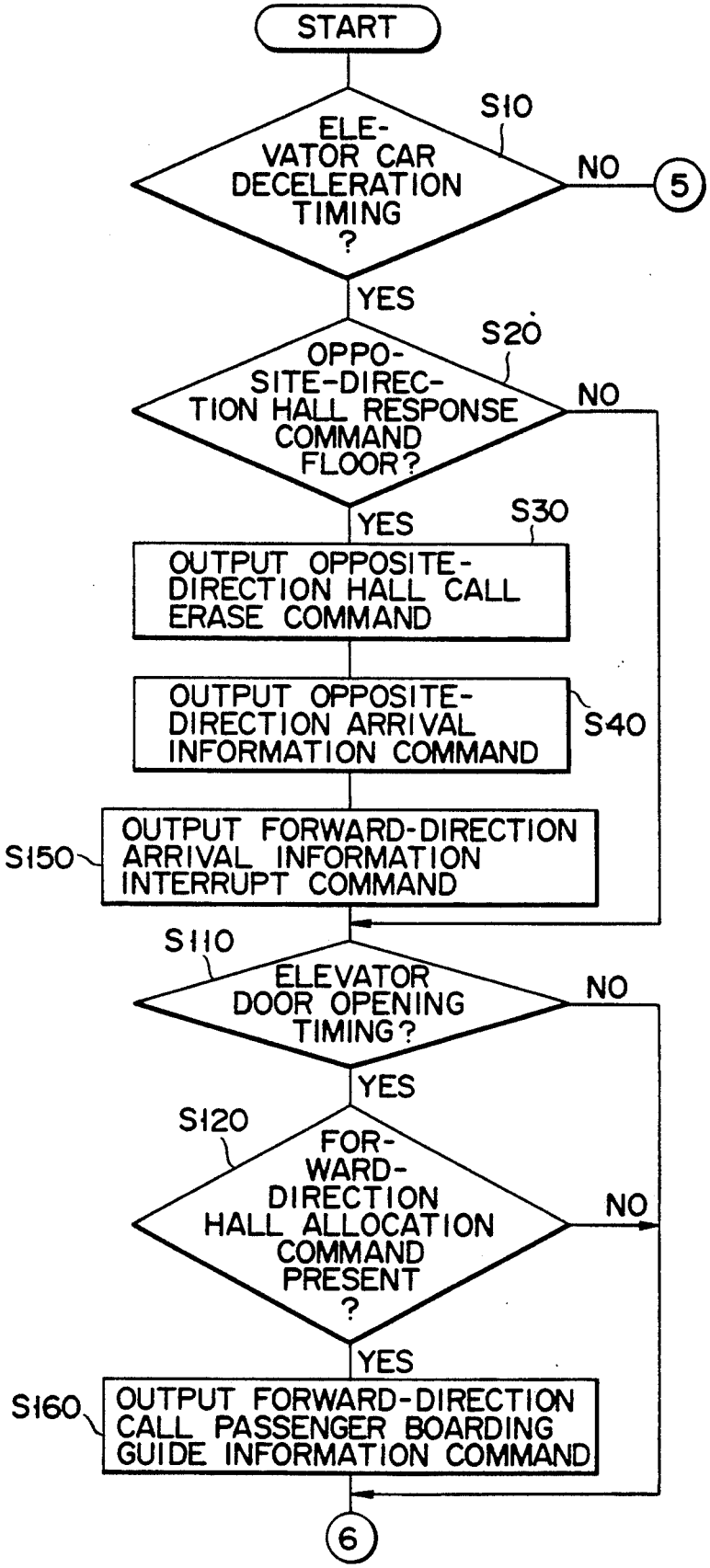
FIGS. 19A and 19B are flow charts for explaining an operation of FIG. 18.
Figure 19B:
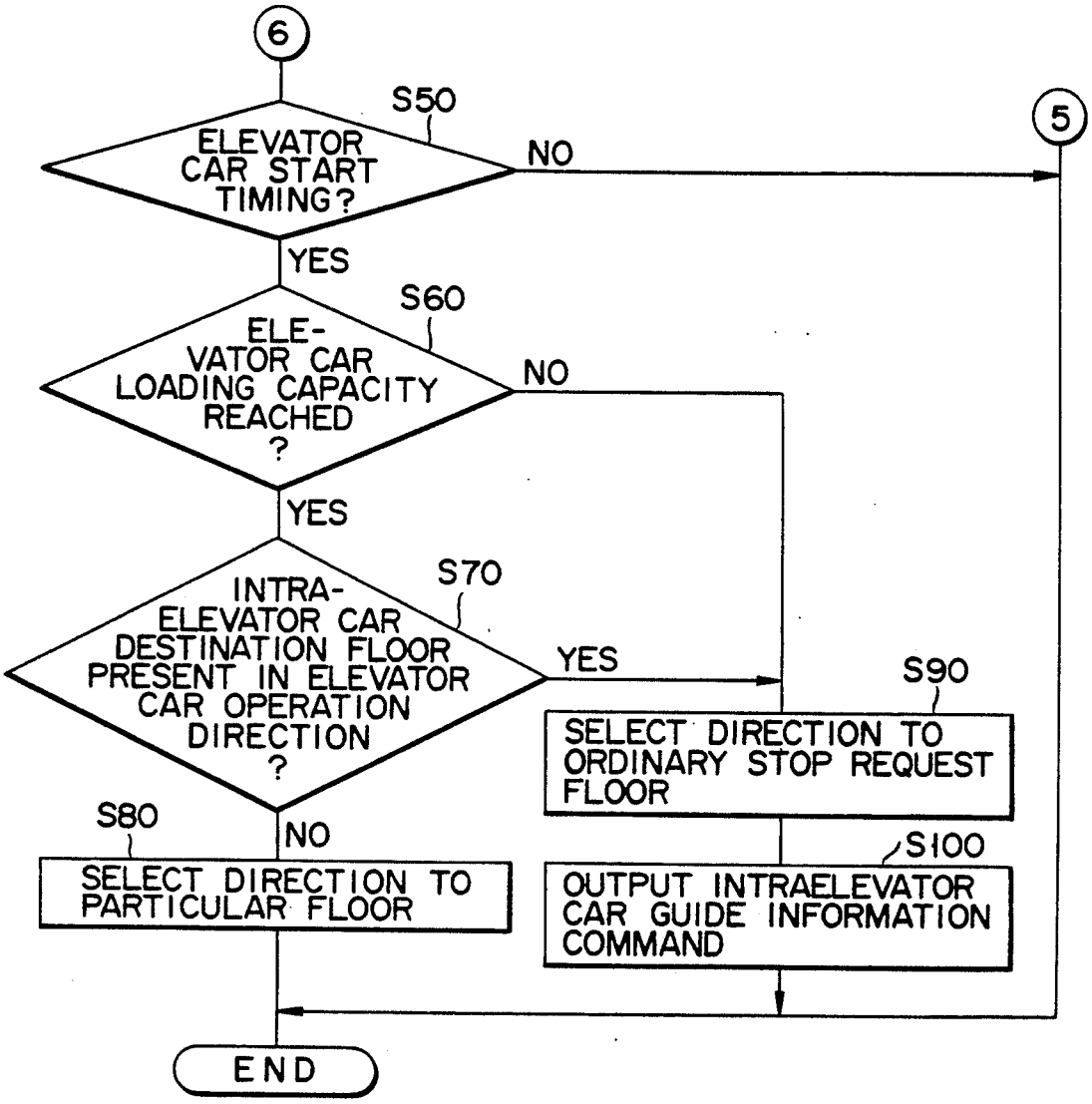

The second modification of the second embodiment of the present invention will be described below with reference to a view for explaining a schematic operation shown in FIG. 18 and a flow chart shown in FIGS. 19A and 19B, in which the same reference numerals denote the same parts and only the different portions will be described. In the second embodiment, when a hall call in a direction opposite to a particular floor is present, the elevator information unit 13 flickers hall lanterns indicating both the directions of an elevator car allocated for a low service quality floor, and gives guide information indicating an operation direction of an elevator car upon opening an elevator door. In this modification, however, when a hall call in a direction opposite to a particular floor is present with respect to an elevator car allocated to a low service quality floor, the elevator information unit 13 flickers only a hall lantern indicating a direction to a low service quality floor, and gives guide information for guiding passengers heading for an operation direction of an elevator car upon opening an elevator door.

The above operation is performed by another operation of the elevator car control unit $5_{al}$ corresponding to an opposite-direction response command by the response elevator car allocation unit 11 shown in FIG. 13. In the condition 2 shown in FIG. 18B, deceleration is performed for the floor f3 when an opposite direction, i.e., an UP direction is selected (step S10 in FIG. 19A). In step S10, a DOWN call on the floor $f_3$ is erased, and a hall lantern indicating DOWN is flickered (step S30), thereby executing an elevator car opposite-direction arrival information command (step S40). In order to give priority to guidance for passengers heading for a DOWN direction, a command for interrupting arrival information of an elevator car in a forward direction, i.e., an UP direction is output (step S150).

In step S150, although the UP hall call is erased, flickering of the hall lantern indicating UP is not performed. Therefore, as shown in FIG. 18B, only the hall lantern indicating DOWN is flickered. That is, only the hall lantern indicating DOWN is flickered for passengers waiting in the hall upon an opening an elevator door. Therefore, since no boarding guidance is performed for passengers heading for the elevator car operation direction, i.e., the UP direction, a guide information command for guiding passengers heading for the UP direction is output (step S160) in the second modification in which the forward-direction hall allocation command is present. An example of the guide information command performed by a voice is "up passengers are also welcomed".

As described above, since the passengers heading for the UP direction in the hall of the floor $f_3$ can recognize boarding guidance to an elevator car by the boarding guide information, they can get on an elevator car without being confused. An operation following the above operation is the same as that shown in FIG. 15B of the second embodiment.

According to the second embodiment as described above, when passengers are to be carried to a particular floor such as a restaurant floor in a special time period such as the first half of a lunch break, service quality can be equalized between floors and a transportation efficiency to the restaurant floor can be increased without lowering convenience in use of passengers waiting in halls.

Figure 20:
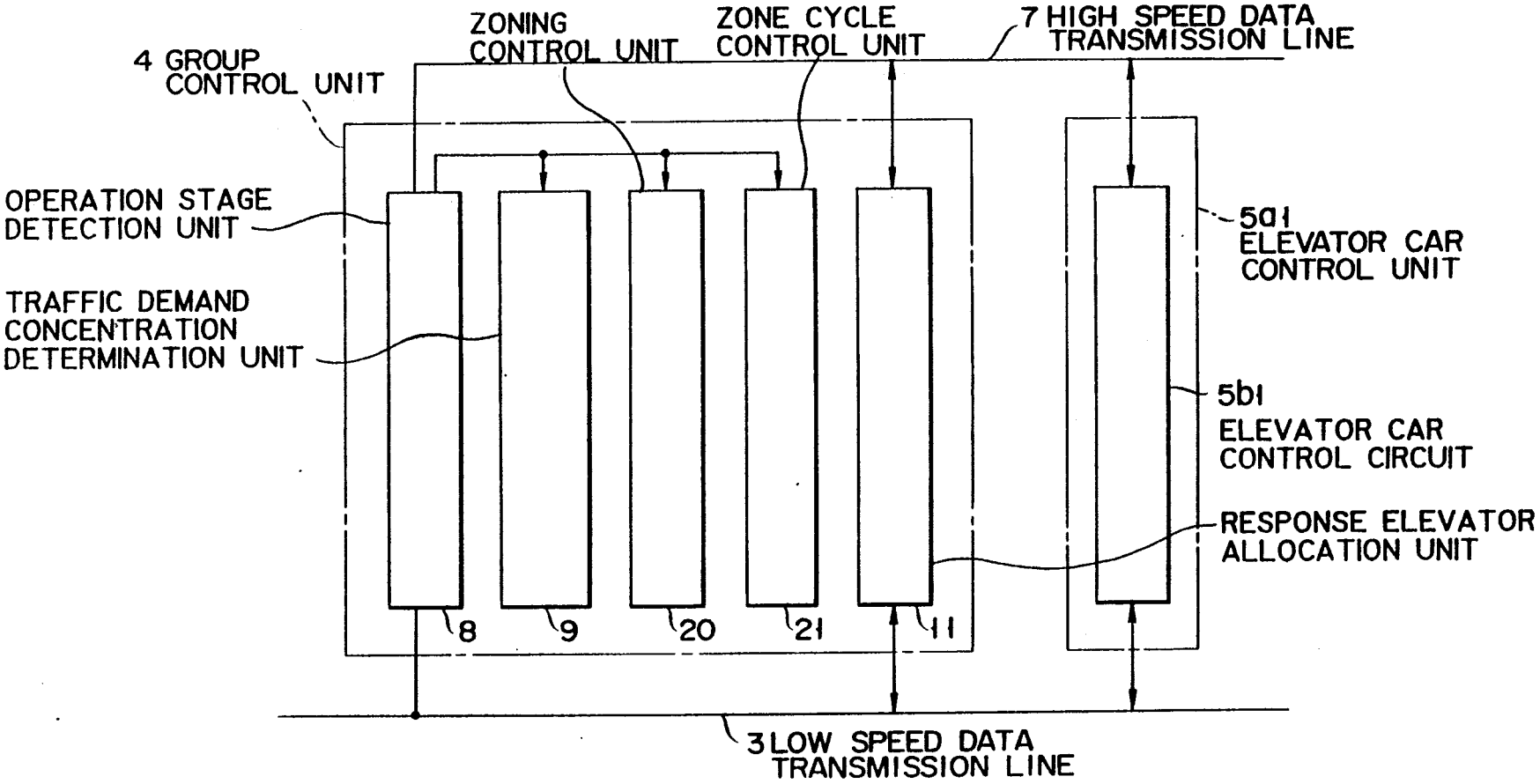
FIG. 20 is a block diagram showing a schematic arrangement of the third embodiment of the present invention.

The third embodiment of the present invention will be described below with reference to FIGS. 20 to 25. FIG. 20 shows a schematic arrangement of the third embodiment, which comprises a zoning control unit 20 for dividing, when a traffic demand concentration determination unit 9 determines that a traffic demand is concentrated, service floors into a plurality of service zones in accordance with the number of elevator cars and causing the elevator cars to perform response in units of the divided zones, a response elevator car allocation unit 11 for causing an elevator car, which is caused to respond to a floor determination by the zoning control unit 20, to respond to the floor when the elevator car is operated in a direction opposite to a particular floor, and a zone cycle control unit 21 for circulating floors, of the floors determined by the zoning control unit 20, to which elevator cars are caused to respond by the response elevator car allocation unit 11.

An operation of the third embodiment having the above arrangement will be described below with reference to FIGS. 21A to 25.

Figure 21A:
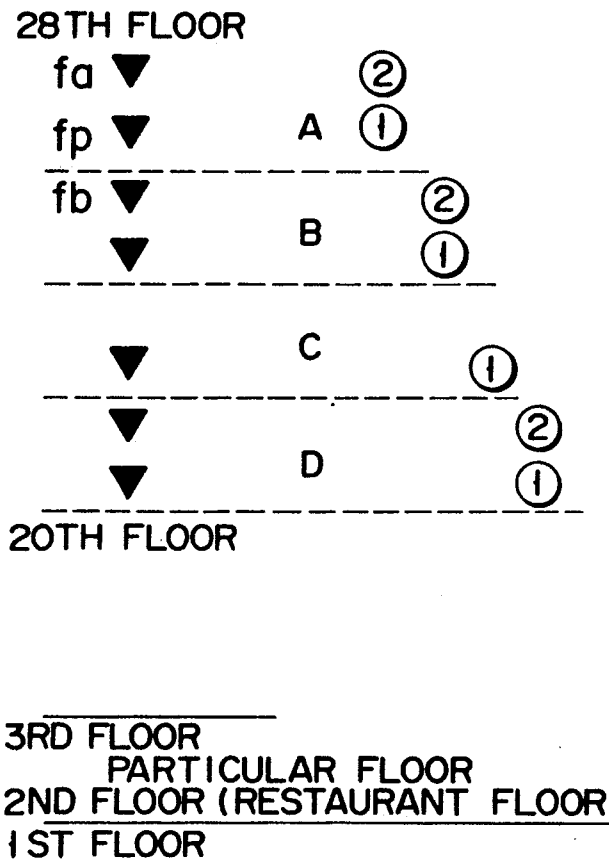
FIGS. 21A and 21B are views for explaining an entire schematic operation of FIG. 20.
Figure 21B:
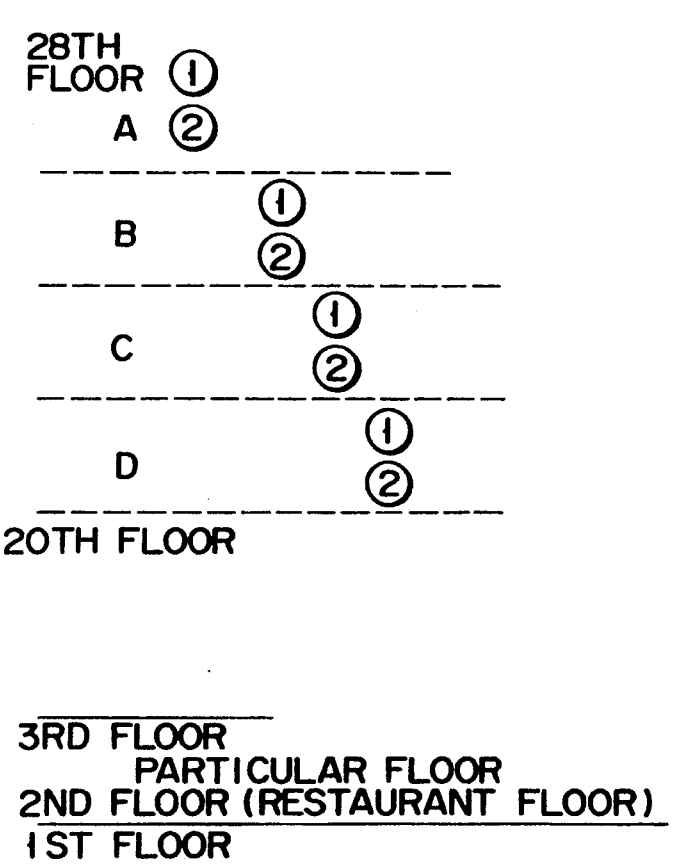

FIGS. 21A and 21B show zoning of elevator cars with respect to floors and a cyclic operation in units of zones. Referring to FIG. 21A, when an elevator car A is allocated to floors $f_a$ and $f_p$, the elevator car A responds in an order of the floors $f_p$ and $f_a$. Referring to FIG. 21B, on the contrary, the elevator car A performs responds in an order of the floors $f_a$ and $f_p$. The operations shown in FIGS. 21A and 21B are alternately performed.

Figure 22B:
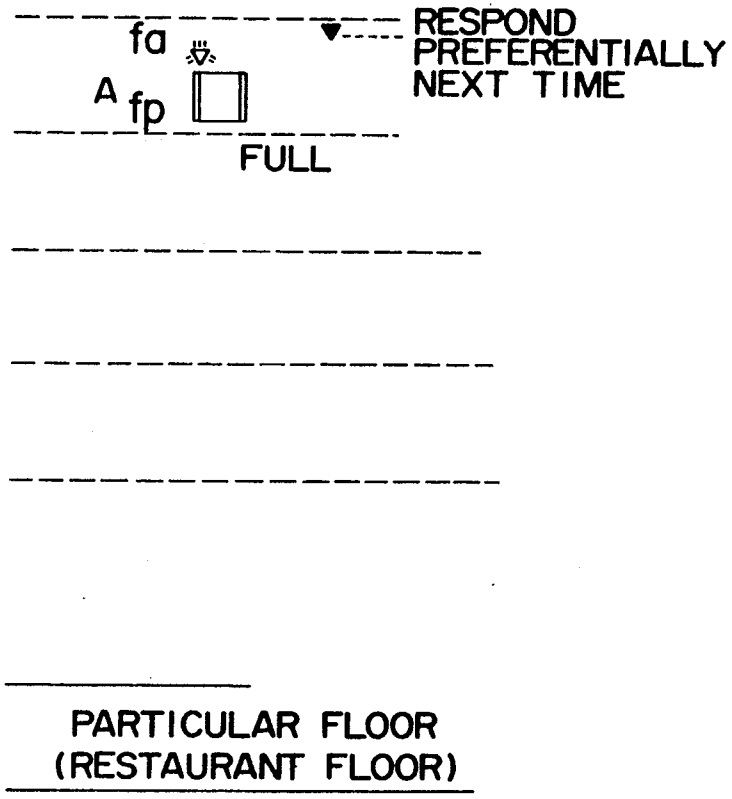
FIGS. 22A and 22B are views for explaining an entire schematic operation of FIG. 20.
Figure 22A:
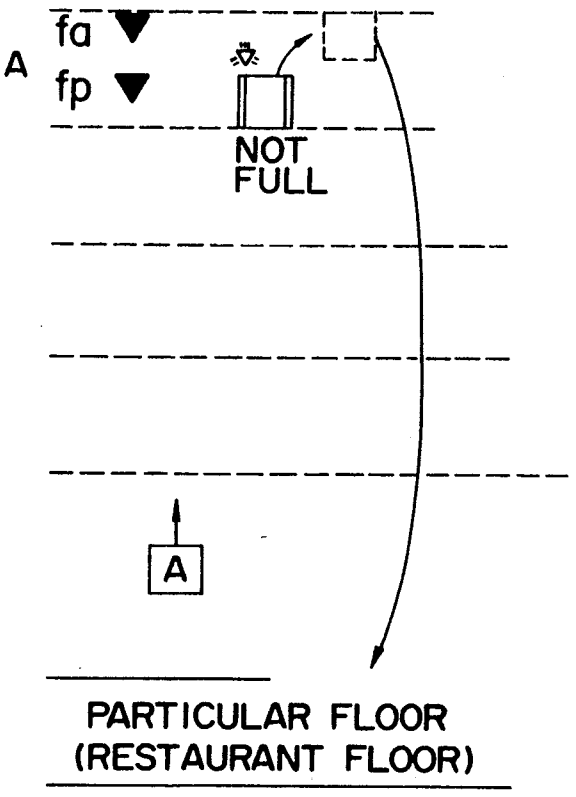

FIG. 22A and 22B are views for explaining a schematic operation of FIGS. 15A and 15B. Both the floors $f_a$ and $f_p$ are present in a zone A (corresponding to the elevator car A), and the elevator car A is caused to respond to the floor $f_p$ by the zoning control unit 20 of this embodiment. In this case, a hall lantern indicating a direction to a particular floor is flickered. If the elevator car is "not full" on the floor $f_p$ as shown in FIG. 22A, the elevator car A responds to also the floor $f_a$. In this case, a guidance indicating "this elevator car temporarily goes up" or the like is performed by a voice or a display so that passengers in the elevator car are not confused. Thereafter, the elevator car responds to the floor $f_p$.

If, on the other hand, the elevator car is "full" on the floor $f_p$ as shown in FIG. 22B, the elevator car directly operates in a direction heading toward the particular floor, and control is so performed as to give priority to the floor $f_a$ next.

Figure 23:
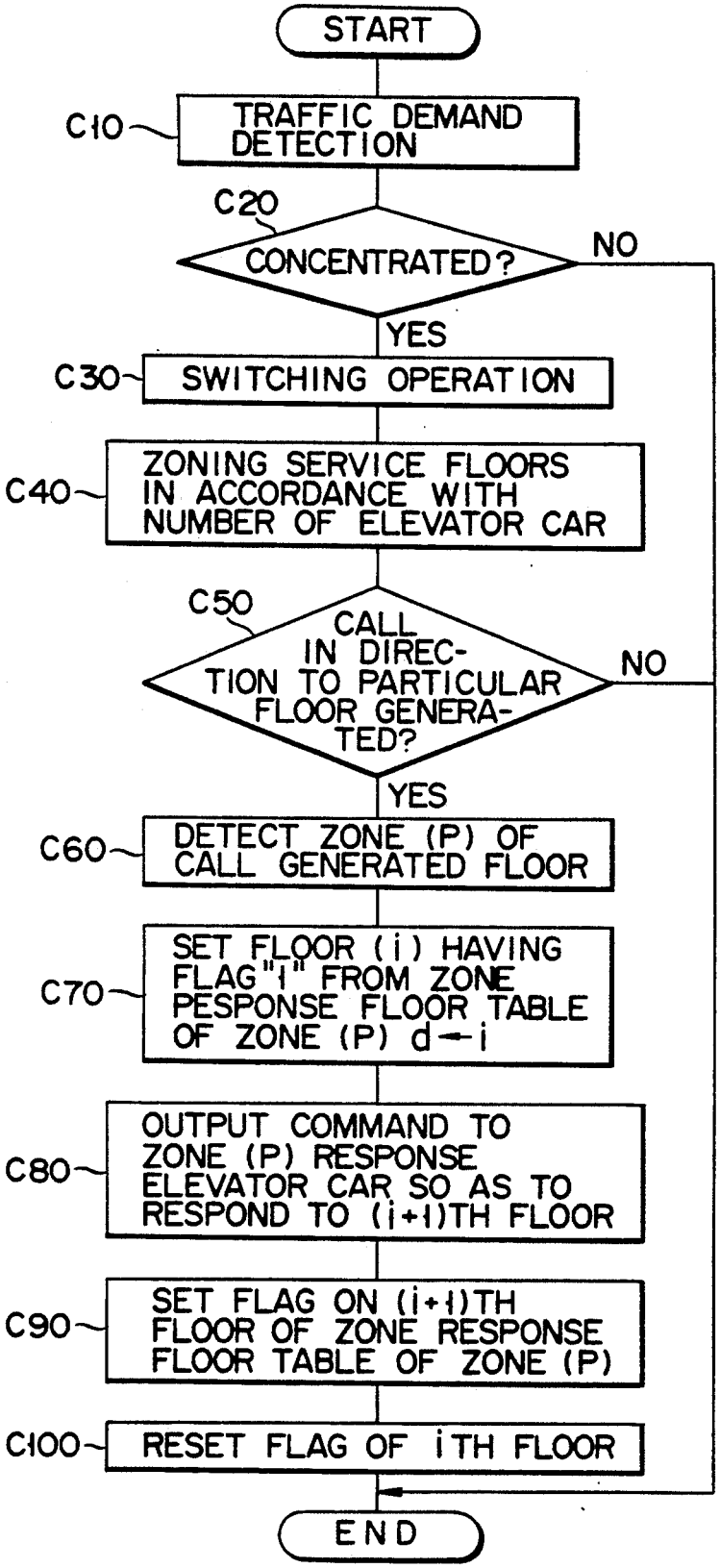
FIG. 23 is a flow chart for explaining an entire schematic operation of FIG. 20.
Figure 24:
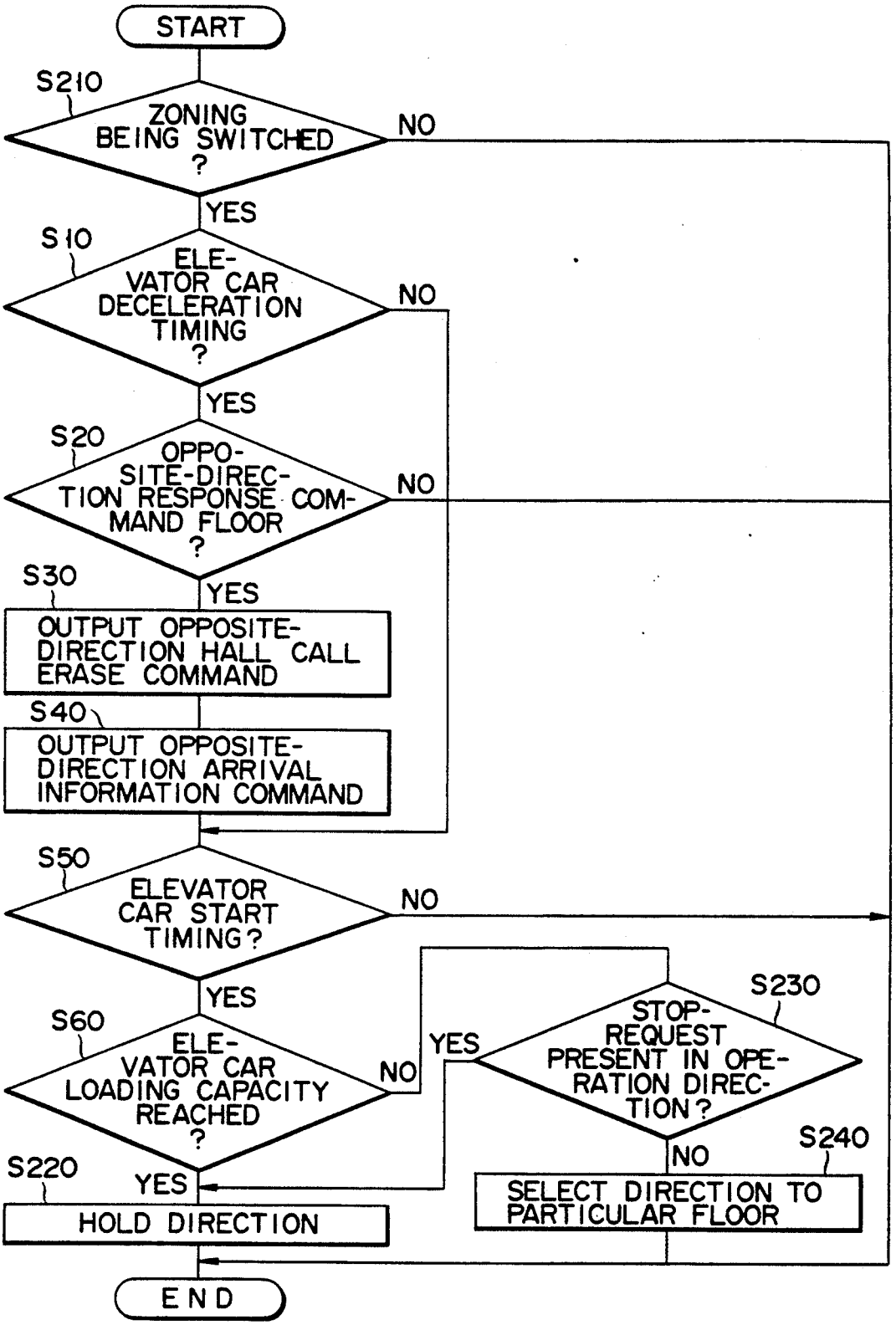
FIG. 24 is a flow chart for explaining an entire schematic operation of FIG. 20.

FIG. 23 is a flow chart for explaining operations of the zoning control unit 20 and the zone cycle control unit 21, and FIG. 24 is a flow chart for explaining an operation of an elevator car control unit $5_{al}$ which operates upon receiving a command from the zoning control unit 20.

If the traffic demand concentration determination unit 9 determines that a traffic demand is concentrated as shown in step C20 of FIG. 23, service floors are divided into a plurality of service zones in accordance with the number of elevator cars (step S210). Elevator car deceleration is performed when an UP direction is selected (step S10). A DOWN call on the floor $f_3$ is erased (steps S20 and S30), and a lantern indicating DOWN is flickered to give opposite-direction arrival information (step S40). After passengers get on from the floor $f_3$ to the elevator car, a direction is selected upon a start timing of the elevator car (step S50). Whether the elevator car loading capacity is reached upon boarding on the floor $f_3$ is checked (step S60), and whether a stop request is present in the operation direction is checked (step S230). If no stop request is present in the operation direction, a direction is selected to a particular floor (step S240). If a stop request is present in the operation direction in step S230 or if the elevator car loading capacity is not reached in step S60, the elevator car operation direction is held (step S220).

As shown in the flow chart of FIG. 23, an operational state detection unit 8 detects operational states of individual elevator cars, i.e., a traffic demand from elevator car control circuits $5_{bl}$ to $5_{bm}$ (step C10). If the traffic demand concentration determination unit 9 determines that the traffic demand is concentrated (step C20), an operation is switched from an ordinary operation to a special operation of this embodiment (step C30).

When the traffic demand is concentrated and a call in a direction to a particular floor can be performed on most of the floors, the zoning control unit 20 performs zoning in accordance with the number of elevator cars in order to operate them at a high efficiency (step C40). Assume that a restaurant is present on the second floor of a 28-story building. As shown in FIGS. 21A and 21B, four elevator cars (A, B, C, and D) are available and give service to eight floors. As shown in FIGS. 21A and 21B, the third to 20th floors are present in an express zone, and assume that a call in a direction to a particular floor is performed on most of floors from the floor $f_a$.

Figure 25:
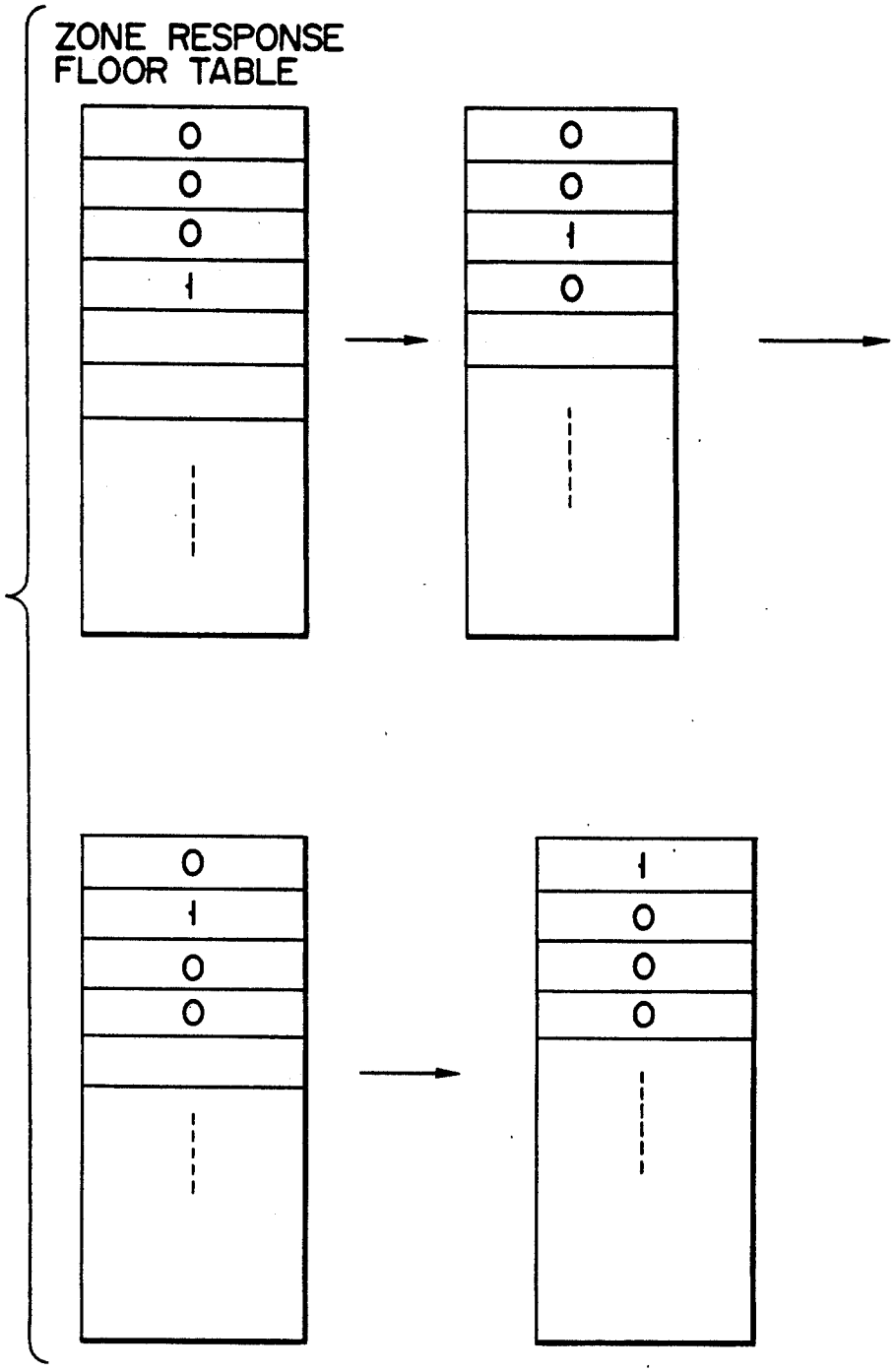
FIG. 25 is a view showing an example of a zone response table shown in FIG. 20.

In the above case, the eight floors are divided into four zones, and elevator cars are allocated in units of zones. In this case, the eight floors are divided into zones A, B, C, and D in units of two floors from the floor $f_a$. The elevator car A is caused to respond to the floor $f_a$, and the elevator car B is caused to respond to the floor $f_b$ (step C40). If 25 passengers are waiting on the floor $f_a$, a 24-passenger elevator car becomes full on the floor $f_a$. In conventional systems, since an elevator car to serve next also responds to the floor $f_a$ first, service quality on the floor $f_p$ is degraded. Therefore, the response elevator car allocation unit 11 controls the elevator cars to respond when they operate in a direction opposite to the particular floor (step C50). That is, the elevator car A is caused to respond in an order of $f_p$ and $f_a$. If the floors $f_p$ and $f_a$ are constantly serviced in this order, the floor $f_p$ is always preferentially serviced. Therefore, the zone cycle control unit 20 cyclically changes a predetermined response order of the floors $f_a$ and $f_p$ in the zone A (step C60). If three floors or more, e.g., floors $f_1$, $f_2$, and $f_3$ are present in a zone, elevator cars respond in an order of $f_1$, $f_2$ and $f_3$ first and then in an order of $f_3$, $f_2$ and $f_1$. By the above operation, elevator cars can be prevented from constantly responding to the floor $f_1$ first (steps C70 and C80). When response is constantly performed in a zone by the principle of the same select/correct operation, the floor $f_a$ shown in FIGS. 21A and 21B is advantageously serviced even if the floors are zoned to increase an operation efficiency. Therefore, control is so performed as to cyclically vary an initial stop floor in a zone. The zone cycle control unit 21 performs this control by setting a flag on an initial response floor in a zone in units of zones (steps C90 and C100). FIG. 25 shows an example of a zone response table.

According to the third embodiment, group control is performed in a time period such as the first half of a lunch break in which a demand for a particular floor such as a restaurant is dominant. Therefore, when passengers are to be carried to the particular floor such as a restaurant floor, elevator cars can be operated in a state full of passengers, and service quality can be equalized between floors. Especially in a building occupied by a single company, the entire operation efficiency can be further improved by zoning.

By performing the control operations as described in the first to third embodiments as needed, elevator cars can perform response in an order of arrival at halls. Therefore, passengers can be equally carried.

The present invention is not limited to the above embodiments but can be modified as follows. That is, in the embodiment shown in FIG. 3, elevator cars respond in an opposite direction, assuming that the floor $f_3$ is a low service quality floor. However, the present invention can be similarly practiced even if a plurality of low service quality floors are set.

The traffic demand concentration determination unit 9 and the low service quality floor detection unit 10 of each embodiment need not be those of the above embodiments but can be arbitrarily modified.

In addition, although a restaurant floor is exemplified as a particular floor in each of the above embodiments, the present invention can be similarly applied to down peak hours such as check out at a hotel, smorgasbord breakfast at a hotel, and the closing time of a public office. The control in each embodiment can be performed on the basis of timepiece conditions or a non-personnel manager.

Zones in the embodiment shown in FIG. 20 need not be equally divided but arbitrarily determined by the control unit, and the cycle of the zone cycle control unit 21 may be either constant or at random.

Although two floors are present in each zone in the embodiment shown in FIG. 20, three floors or more may be present in each zone, or four zones may be serviced by three elevator cars. That is, the present invention can be variously modified and practiced without departing from the spirit and scope of the invention.

Additional advantages and modifications will readily occur to those skilled in the art. Therefore, the invention in its broader aspects is not limited to the specific details, representative devices, and shown and described herein. Accordingly, various modifications may be without departing from the spirit or scope of the general inventive concept as defined by the appended claims and their equivalents.

What is claimed is:

1. An apparatus for elevator group control, in which a plurality of elevator cars are operated between a plurality of floors, and one of said plurality of elevator cars is allocated to respond to a hall call generated by passengers on each floor, comprising:

operation state detecting means for detecting operation modes of said elevator cars corresponding to particular hall call destinations at particular time periods of the day;

traffic demand concentration determining means for determining, on the basis of the detection result of said operation state detecting means, whether a plurality of traffic demands in the elevator system are concentrated at one or more floors;

low service quality floor detecting means for detecting, when said traffic demand concentration determining means determines that said traffic demands are concentrated, a low service quality floor at which service is lower than at other floors as a result of concentration of the traffic demands; and elevator responding means for causing an elevator car, which is allocated to said low service quality floor detected by said low service quality floor detecting means, to respond to said low service quality floor when said elevator car operates in a direction opposite to a particular floor and a hall call of said low service quality floor is in the direction toward said particular floor, wherein said low service quality floor detecting means determines, as said low service quality floor, at least one of (1) a floor from which an elevator car starts full of passengers in a direction toward a particular floor at a time preceding stopping of said elevator car, (2) a hall call allocating a floor which has been passed by an elevator car full of passengers, (3) a floor at which a hall call waiting time is a predetermined time or more, (4) a floor at which a predicted nonresponse time is a predetermined time or more, (5) a floor having a maximum nonresponse time of hall calls allocating floors to an elevator car operating in a direction toward a particular floor, (6) a floor at which the number of passengers capable of getting on is a predetermined value or less at a time preceding stopping of said elevator car, and (7) a floor at which a boarding accumulated value ratio of the floor in a predetermined time period is lower than a boarding queue based on past statistical data.

2. An apparatus for elevator group control, in which a plurality of elevator cars are operated between a plurality of floors, and one of said plurality of elevator cars is allocated to respond to a hall call generated by passengers on each floor, comprising:

operational state detecting means for detecting operation modes of said elevator cars corresponding to particular hall call destinations at particular time periods of the day;

traffic demand concentration determining means for determining, on the basis of the detection result of said operational state detecting means, whether a plurality of traffic demands in the elevator system are concentrated at one or more floors;

low service quality floor detecting means for extracting, when said traffic demand concentration determining means determines that said traffic demands are concentrated, a low service quality floor at which service is lower than at other floors as a result of concentration of the traffic demands, and determining said extracted floor as a low service quality floor;

elevator responding means for causing an elevator car, which is allocated to said low service quality floor determined by said low service quality floor detecting means, to respond to said low service quality floor when said elevator car operates in a direction opposite to a particular floor and a hall call of said low service quality floor is in the direction toward said particular floor;

bidirectional call detecting means for detecting a hall call wherein the direction of the call is opposite to said particular floor, on said low service quality floor; and elevator informing means for causing, when a hall call in a direction opposite to said particular floor is present, a hall indicator of an elevator car, allocated to said low service quality floor, to perform indication in a form different from an ordinary form, and giving guide information for indicating an elevator car operation direction and for guiding passengers upon opening of an elevator door.

3. An apparatus according to claim 2, wherein when a hall call is made from a direction opposite to said particular floor for an elevator car allocated to said low service quality floor, said elevator informing means includes one of the following indicators:

(1) flickering of hall lanterns indicating both directions for providing guide information indicating an elevator car operation direction upon the opening of an elevator door, (2) flickering of only a hall lantern indicating an elevator car operation direction and providing guide information for guiding passengers heading for a direction to a low service quality floor upon the opening of an elevator door, or (3) flickering only a hall lantern indicating an elevator car operation direction and providing guide information for guiding passengers heading for an elevator car operation direction upon the opening of an elevator door.

4. An apparatus according to claim 3, wherein the guide information is given by a voice.

5. An apparatus for elevator group control, in which a plurality of elevator cars are operated between a plurality of floors, and one of said plurality of elevator cars is allocated to respond to a hall call generated by passengers on each floor, comprising:

operational state detecting means for detecting operation modes of said elevator cars corresponding to particular hall call destinations at particular time periods of the day;

traffic demand concentration determining means for determining, on the basis of the detection result of said operational state detecting means, whether a plurality of traffic demands in the elevator system are concentrated at one or more floors;

zoning control means for dividing, when said traffic demand concentration determining means determines that traffic demands are concentrated, said floors into a plurality of service zones in accordance with the number of elevator cars, and causing said elevator cars to respond to said floors in units of said divided zones;

elevator responding means for causing an elevator car to respond to corresponding floors divided by said zoning control means; and zone cycle control means for equally circulating calls to floors to be responded to, which floors are determined by said zoning control means, with respect to said elevator responding means.

* * * * *